US005929741A

United States Patent [19]

Nishimura et al.

[11] Patent Number: 5,929,741

[45] Date of Patent: Jul. 27, 1999

[54] CURRENT PROTECTOR

[75] Inventors: Atsushi Nishimura, Yuki; Kouichi Tsuyama; Yorio Iwasaki, both of Shimodate; Yutaka Taniguchi, Ibaraki-ken; Mituo Teppozuka, Shimodate; Wataru Shimizu, Shimodate; Kousuke Takada, Shimodate; Hisaji Kobori, Tsuchiura, all of Japan

[73] Assignee: Hitachi Chemical Company, Ltd., Tokyo, Japan

[21] Appl. No.: 08/562,185

[22] Filed: Nov. 22, 1995

[30] Foreign Application Priority Data

| | | | |
|---|---|---|---|
| Nov. 30, 1994 | [JP] | Japan | 6-296455 |
| Nov. 30, 1994 | [JP] | Japan | 6-296456 |
| Nov. 30, 1994 | [JP] | Japan | 6-296457 |
| Nov. 30, 1994 | [JP] | Japan | 6-296458 |
| Nov. 30, 1994 | [JP] | Japan | 6-296459 |
| Nov. 30, 1994 | [JP] | Japan | 6-296460 |
| Dec. 1, 1994 | [JP] | Japan | 6-298275 |

[51] Int. Cl.[6] ..... H01H 85/046; H01H 85/055; H01H 85/08; H01H 85/12

[52] U.S. Cl. ..... 337/290; 337/293; 337/297; 337/159

[58] Field of Search ..... 337/290, 292, 337/295, 297, 159, 161, 227; 361/104

[56] References Cited

U.S. PATENT DOCUMENTS

| | | | |
|---|---|---|---|
| 3,585,556 | 6/1971 | Hingorany | 337/159 |
| 3,627,565 | 12/1971 | Plueddemann | 117/72 |
| 3,980,729 | 9/1976 | Yokokawa et al. | 260/826 |
| 4,097,286 | 6/1978 | Dafter, Jr. | 106/1.11 |
| 4,140,988 | 2/1979 | Oakes | 337/279 |
| 4,296,398 | 10/1981 | McGalliard | 337/297 |
| 4,557,957 | 12/1985 | Manniso | 428/36 |
| 4,559,514 | 12/1985 | Arikawa . | |
| 4,626,818 | 12/1986 | Hilgers | 337/166 |
| 4,770,927 | 9/1988 | Effenberger et al. | 428/245 |
| 4,989,119 | 1/1991 | Gouvernelle . | |
| 5,015,514 | 5/1991 | Rinehart | 428/36.4 |
| 5,027,101 | 6/1991 | Morrill, Jr. . | |
| 5,070,047 | 12/1991 | Gardner et al. | 501/16 |
| 5,097,246 | 3/1992 | Cook et al. | 337/297 |
| 5,120,579 | 6/1992 | Gardner et al. | 427/376.2 |
| 5,140,295 | 8/1992 | Vermot-gaud et al. | 337/297 |
| 5,166,656 | 11/1992 | Badihi et al. . | |
| 5,228,188 | 7/1993 | Badihi et al. . | |
| 5,232,962 | 8/1993 | Dershem et al. | 523/442 |
| 5,261,154 | 11/1993 | Ferrier et al. | 29/830 |
| 5,280,098 | 1/1994 | Witucki et al. | 528/17 |
| 5,296,833 | 3/1994 | Breen et al. . | |
| 5,309,625 | 5/1994 | Onishi | 29/623 |
| 5,397,830 | 3/1995 | Shaikh et al. | 524/494 |

FOREIGN PATENT DOCUMENTS

| | | | |
|---|---|---|---|
| A 5-166454 | of 0000 | Japan . | |
| A 60-143544 | of 0000 | Japan . | |
| A 63-141233 | 6/1988 | Japan | H01H 85/00 |
| 403169904 | 7/1991 | Japan | H01L 21/82 |
| 404065046 | 3/1992 | Japan | H01H 85/048 |
| 4-248221 | 9/1992 | Japan . | |
| 405166454 | 7/1993 | Japan | H01H 85/17 |
| 407105824 | 4/1995 | Japan | H01H 85/00 |

*Primary Examiner*—Leo P. Picard
*Assistant Examiner*—Anatoly Vortman
*Attorney, Agent, or Firm*—Antonelli, Terry, Stout & Kraus, LLP

[57] ABSTRACT

A current protector comprising an organic resin-made insulating substrate, a pair of terminals formed at both ends of the insulating substrate, and an electrical conductor electrically connecting the terminals and having a thickness of 3–8 μm and formed in or on the insulating substrate, is excellent in suppressing ignition and smoking at the time of blowing, and can be improved in clearing characteristics by various modifications.

3 Claims, 17 Drawing Sheets

CURRENT PROTECTOR

BACKGROUND OF THE INVENTION

This invention relates to a current protector, particularly an organic resin-made chip type current protector and processes for producing the same.

Current protectors are used for protecting electronic devices from over-current acting as an automatic circuit-interrupting device. The current protector used in the present invention is connected in series to an electric circuit and is subjected to blowing of a fusible link in the current protector under over-current conditions so as to protect devices by breaking an electric current thereafter. Such an element is generally called a fuse. When the term "fuse" is used, the element should satisfy the required properties specified in various regulations. But with recent diversification of electronic devices, there appear current protectors having properties different from those specified in the regulations for the fuse. In the present invention, the term "current protector" is used in a wide meaning including conventional fuses and having the properties and operational mechanism mentioned above.

As over-current protecting devices, there can be used as electronic switches using thyristors or transistors in addition to the above-mentioned current protectors. But such devices were not always suitable for devices which require miniaturization and a low consuming electric power such as portable devices operated by a battery due to an increase in circuit parts and an increase in electric power consumed by a protective circuit.

As current protectors having improved properties, JP-A-60-143544 disclosed a current protector (or fuse) comprising a ceramic substrate and formed thereon a three-layered electrical conductor comprising a first layer of silver or silver-palladium, a second layer of nickel and a third layer of solder or tin so as to improve clearing (or blowing) characteristics at the time of soldering. It was also disclosed therein to cover the electrical conductor surface with an incombustible (or fire retardant) resin such as a silicon resin. But such a structure wherein the fuse was formed on the ceramic substrate which is small in thermal resistance, was high in heat dissipation and had a problem in that a current value for blowing often changed depending on ambient temperatures, even if covered with the incombustible (or fire retardant) resin as disclosed by JP-A-60-143544.

In order to solve the problem of using the ceramic substrate, it was proposed to use organic resin-made insulating substrates. But when an epoxy resin, a phenol resin, a polyimide resin, etc. were used as the substrate, there were problems in fuming and combustion.

JP-A-5-166454 disclosed the use of a fluorine resin as the insulating substrate so as to lower thermal conductivity compared with ceramic and to improve blowing accuracy of the fuse. The surface of fuse was also covered with a silicone resin (rubber).

On the other hand, the fusible link of the fuse was formed by printing or plating (JP-A-63-141233). But the accuracy for forming the fusible link was low and particularly it was difficult to control the thickness of the fusible link. Thus, it was difficult to make scattering of resistance value of the fusible link between lots within 30%.

According to JP-A-5-166454, the fusible link was formed by forming a thin metal layer by plating, followed by etching. Such a fusible link was excellent in clearing (or blowing) characteristics, but poor in controlling the uniform thickness of plated layer due to difficulty in controlling of plating conditions such as the composition of a plating bath, etc. Thus, it was difficult to make the scattering of resistance value between lots within 30%. Further, since the fusible link was formed by etching of plated thin metal layer according to JP-A-5-166454, it was impossible to obtain sufficient connection reliability for a long period of time when subjected to an accelerated test of heat cycle test. In addition, according to JP-A-5-166454, since the surface of fusible link was covered with the silicone rubber, the silicone rubber was often damaged and caused slight fuming for 1 or 2 seconds due to high temperatures at the time of blowing depending on over-current conditions.

SUMMARY OF THE INVENTION

It is an object of the present invention to provide current protectors excellent in suppressing fuming and ignition at the time of blowing while suppressing heat dissipation, and processes for producing the same.

The present invention provides a current protector comprising an organic resin-made insulating substrate, a pair of conductive terminals formed on both ends of the insulating substrate, and an electrical conductor for electrically connecting the terminals, said electrical conductor including one or more fusible links, formed in or on the insulating substrate and made of a metal layer having a thickness of 3 to 8 $\mu$m.

The present invention also provides a current protector having the structure as mentioned above and characterized in that the electrical conductor is formed on the insulating substrate and has three or more odd number of high resistance portions formed by narrowing the width of electrical conductor, and low resistance portions connecting the high resistance portions, respectively, one of the high resistance portions being positioned in the center of the electrical conductor and the rest of the high resistance portions being positioned symmetrically with regard to the central high resistance portion.

The present invention further provides a current protector having the structure as mentioned above in the form of a chip and characterized in that the electrical conductor is formed on the insulating substrate and covered with a fluorine resin layer having a thickness of 40 to 200 $\mu$m, and processes for producing the same.

The present invention still further provides a current protector having the structure as mentioned above in the form of a chip and characterized in that the electrical conductor is formed in the insulating substrate and sandwiched by a pair of light-shielding metal foils, and processes for producing the same.

The present invention also provides a current protector having the structure as mentioned above in the form of a chip and characterized in that the insulating substrate is made from a fluorine resin, and when the electrical conductor is formed on the insulating substrate, it is covered with a fluorine resin, and processes for producing the same.

The present invention further provides a current protector having the structure as mentioned above in the form of a chip and characterized in that a vacant space is formed between the electrical conductor and the resin layer placed thereon.

The present invention still further provides a current protector having the structure as mentioned above in the form of a chip and characterized in that the electrical conductor is formed in the insulating substrate and a vacant space is formed at least a portion around the electrical conductor to be blowed, and processes for producing the same.

The present invention also provides a current protector having the structure as mentioned above in the form of a chip and characterized in that the electrical conductor has a space or a non-adhesion portion with regard to the underlying insulating substrate, and processes for producing the same.

DESCRIPTION OF THE PREFERRED EMBODIMENTS

Figure 1:
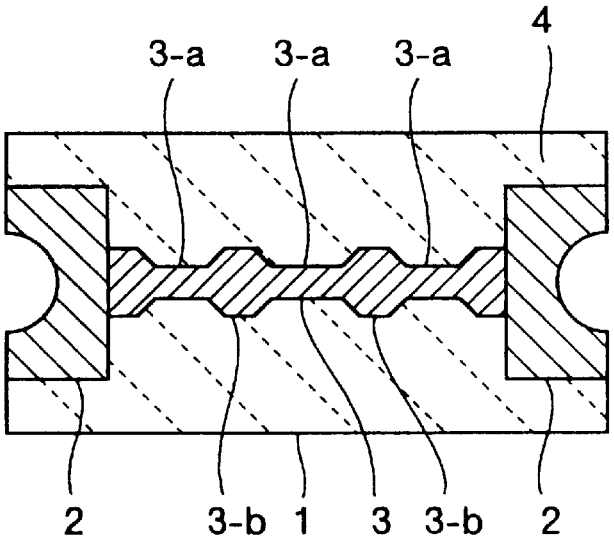
FIG. 1 is a top plan view of the electric conductor of the present invention having different resistance values depending on the width of the conductor.

The current protector of the present invention comprises an organic resin-made insulating substrate, a pair of conductive terminals formed on both ends of the insulating substrate, and an electrical conductor for electrically connecting the terminals, said electrical conductor including one or more fusible links, formed in or on the insulating substrate and made of a metal layer having a thickness of 3 to 8 $\mu$m, provided that when the electrical conductor is formed in the insulating substrate, the electrical conductor is covered with a resin layer.

As the organic resin-made insulating substrate, there can be used a material comprising an organic resin and a reinforcing material. As the organic resin, there can be used a fluorine resin, a phenol resin, an epoxy resin, a polyimide resin, etc. As the reinforcing material, there can be used glass cloth, glass paper, polyamide cloth, polyamide paper, etc. The reinforcing material is not always included in the insulating substrate uniformly. Sometimes, the reinforcing material can be included in the insulating substrate in half, or in various forms and various proportions.

The use of fluorine resin in the insulating substrate is particularly preferable, since the fluorine resin per se is difficult to burn and hardly generates smoke. Examples of the fluorine resin are polytetrafluoroethylene, tetrafluoroethylene-hexafluoropropylene copolymers, tetrafluoroethylene-ethylene copolymers, tetrafluoroethylene-perfluoroalkoxyethylene copolymers, fluorine resins modified with other organic resins, naphtha, white oil (liquid paraffin), etc. From the viewpoint of cost, the use of polytetrafluoroethylene is preferable. Considering low molding temperatures, the use of tetrafluoroethylene-perfluoroalkoxyethylene copolymers, tetrafluoroethylene-ethylene copolymers is preferable.

The electrical conductor includes one or more fusible links and electrically connects a pair of terminals. The thickness of the electrical conductor is 3 to 8 $\mu$m. When the thickness is less than 3 $\mu$m, it is difficult to maintain the thickness accuracy and the generation of pin holes is inevitable. On the other hand, when the thickness is more than 8 $\mu$m, it is difficult to form the electrical conductor which blows precisely under over-current conditions. The width of the electrical conductor is preferably 70 $\mu$m or less.

The electrical conductor can be formed by using a metal foil such as an ultra-thin copper foil, an ultra-thin copper foil carried on aluminum, a second copper layer (ultra-thin copper layer) of a composite metal foil (e.g. a composite metal foil comprising copper (carrier)/nickel alloy (stopper)/copper (ultra-thin copper) disclosed in U.S. Pat. No. 5,403,672).

Considering the object of the present invention, the accuracy of thickness of the metal foil is very important. In order to suppress the scattering of resistance value of the electrical conductor within 15%, it is necessary to maintain the accuracy of thickness of metal foil within about ±5%. In order to suppress the scattering of the resistance value within 12%, it is necessary to make the thickness accuracy of metal foil about ±3%.

The ultra-thin copper foil and composite metal foils can be produced by an electrolytic process, a rolling process, and the like. The accuracy of the thickness is acceptable even for those available commercially. According to the results of weight measuring (in the case of a composite metal foil, the ultra-thin copper layer being dissolved and measured), the scattering is about ±1% in the same lot with regard to the average value. Although the required thickness accuracy changes depending on the allowability of scattering of resistance value, the thickness accuracy of metal foil is preferably within ±5%, more preferably within ±3%, from the above results.

The electrical conductor can be formed on the surface of the insulating substrate or can be included in the insulating substrate. In the case of forming the electrical conductor on the surface of insulating substrate, the resin layer covering the electrical conductor can be formed by coating of a resin or pressing of a resin film. In the case of including the electrical conductor in the insulating substrate, the resin layer of the insulating substrate (the resin layer portion of insulating substrate positioned between the surface and the electrical conductor) corresponds to the resin layer mentioned in the above case.

The electroconductive terminals positioned on the same level as the electrical conductor are better when thick from the viewpoint of prevention of blowing by thermal stress. But from the viewpoint of material cost and moldability, it is better that the terminals are not too thick. Preferable thickness is about 10 to 50 μm. When the thickness of terminal is less than 10 μm, there is a tendency to lower mechanical strength, and to easily break the bonding at the boundary of the terminal portion and the terminal connecting portion under repeated influence of temperature changes. On the other hand, when the thickness is over 50 μm, properties are not changed while the production cost increases.

The electroconductive terminals can be formed by plating and etching, e.g. (i) conducting plating on necessary portions of an ultra-thin copper foil, followed by etching of the rest of the ultra-thin copper foil to form an electrical conductor, (ii) retaining a part of a carrier copper of a composite metal foil [copper (carrier)/nickel alloy (stopper)/copper (ultra-thin copper)] by etching, peeling the exposed stopper layer, and forming an electrical conductor on the ultra-thin copper portion, and the like method.

The current protector of the present invention can be modified variously to provide various additional effects as mentioned below.

[First modification]

The current protector having the structure as mentioned above can be modified in that the electrical conductor is formed on the insulating substrate and has three or more odd number of high resistance portions formed by narrowing the width of electrical conductor, and low resistance portions connecting the high resistance portions, respectively, one of the high resistance portions being positioned in the center of the electrical conductor and the rest of the high resistance portions being positioned symmetrically with regard to the central high resistance portion.

By modifying as mentioned above, consumed electric power can be lowered and protection of the current protector can be improved.

Figure 5A:
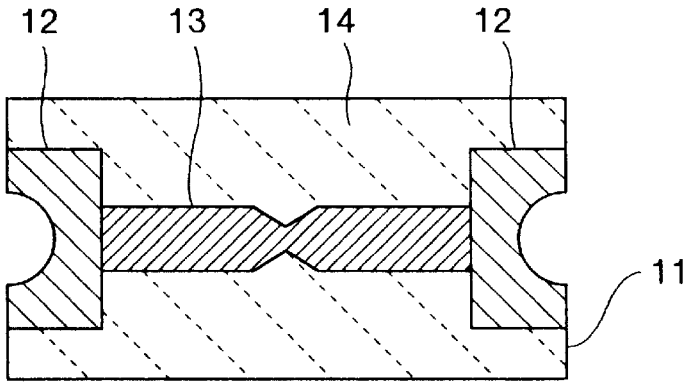
FIGS. 5A to 5C are top plan views of prior art current protectors.
Figure 5B:
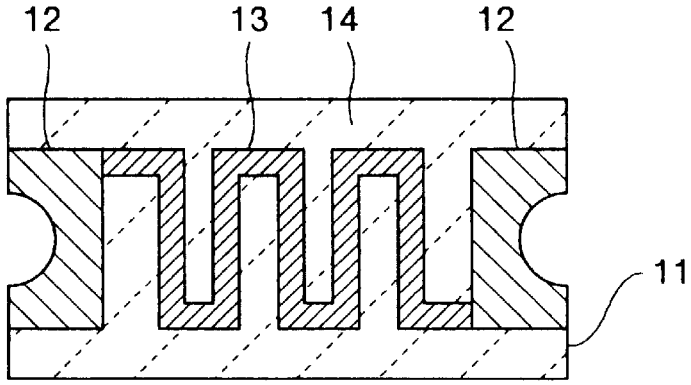
Figure 5C:
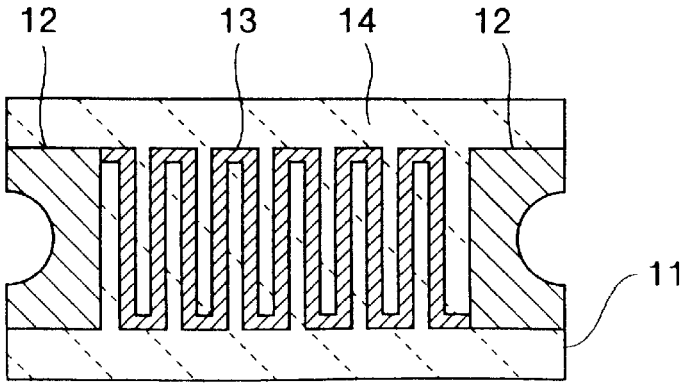

Prior art current protectors have patterns of electrical conductors as shown in FIGS. 5A to 5C.

The pattern shown in FIG. 5A is a generally used pattern having a narrow portion therein, which does not blow near a rated current due to great heat dissipation but instantly blows by over-current due to rapid temperature rise adiabaticly only in the narrow portion.

The patterns shown in FIGS. 5B and 5C are used for low rated current and have a long conductor with a uniform width so as to have a large resistance value and a large heat release value, resulting in blowing even by a low current.

In order to reduce consumed electric power in the protective circuit, a current protector consuming a small amount of electric power has strongly been demanded. According to the pattern shown in FIG. 5A, since the released heat from the narrow portion is great, it is impossible to use such a pattern for low rated current type which has a small heat generation. On the other hand, the patterns shown in FIGS. 5B and 5C consume a large electric power due to large resistance value. Further, according to the patterns of FIGS. 5B and 5C, since the pattern as a whole is heated, remarkable smoking takes place when the patterns are formed on a resin-made substrate such as glass cloth-epoxy resin substrate, resulting in destroying not only the current protector per se but also the printed circuit board mounting the current protector.

According to the pattern shown in FIG. 1 of the present invention, such problems are solved.

In the present invention, the central high resistance portion preferably has a resistance value in the range of 20 to 40% of the total resistance values of the high resistance portions.

Such a conductor pattern can be formed by etching of a metal foil or plating of a metal. As the material for the electrical conductor, the use of copper is preferable economically.

In FIG. 1, the numeral 2 denotes a conductive terminal, and the current protector 1 comprises a conductor pattern 3 formed on an organic resin-made insulating substrate 4, the shape of the electrical conductor being formed by narrowing the width of a linear conductor partly so as to give three or more odd number of high resistance portions 3-*a* and low resistance portions 3-*b* placed between the high resistance portions. One of the high resistance portions 3-*a* is positioned in the center of the pattern 3, and other high resistance portions are positioned symmetrically with regard to the central high resistance portion $(\mathbf{3}\text{-}a)_c$. Apart from FIG. 1, a plurality of high resistance portions 3-*a* can be used so long as being positioned symmetrically with regard to the central high resistance portion.

The thickness of the conductor pattern is 3 to 8 μm, the width of the conductor at the high resistance portion is preferably 30 to 70 μm, and the length of one high resistance portion is preferably 100 to 300 μm. As to the low resistance portion 3-*b*, the width is preferably 150 to 200 μm, and the length of one low resistance portion is 200 to 400 μm. It is preferable to make the resistance value of the central high resistance portion $(\mathbf{3}\text{-}a)_c$ 20 to 40% of the total resistance values of the high resistance portions 3-*a*. When the resistance value is smaller than the above-mentioned range, clearing current becomes larger than the specified value and cannot protect the circuit. When the resistance value becomes too large, clearing current becomes smaller than the specified value and cannot supply electric power to the circuit, or the element acts as a resistor, not as a current protector, resulting in sometimes abnormally operating the circuit for a power supply.

The current protector 1 can preferably be covered with an incombustible resin.

Figure 2:
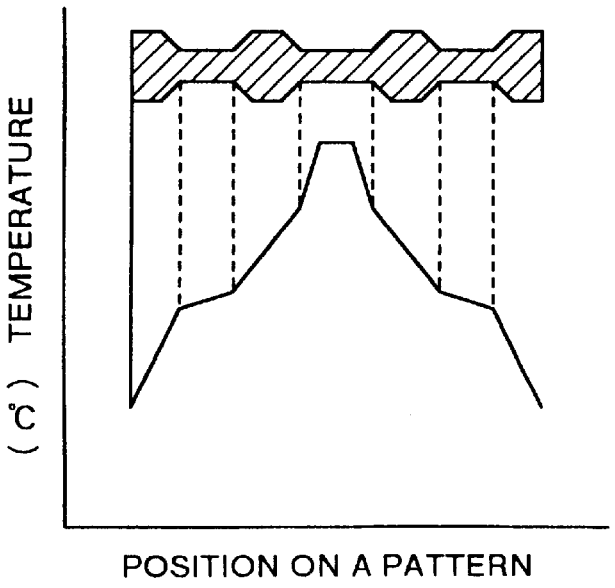
FIG. 2 is a graph showing a temperature distribution at the time of operating the electric conductor in order to explain the function of the current protector of the present invention.

By forming the conductor pattern as shown in FIG. 1, the temperature of the central high resistance portion $(\mathbf{3}\text{-}a)_c$ at the time of passing an electric current becomes the highest as shown in FIG. 2. Thus, when an over-current passes, blowing (or clearing) takes place without fail at the central high resistance portion $(\mathbf{3}\text{-}a)_c$.

Further, when the resistance value of high resistance portions 3-*a* other than central portion is made higher than that of the central high resistance portion $(\mathbf{3}\text{-}a)_c$, the central high resistance portion $(\mathbf{3}\text{-}a)_c$ easily blows due to smaller heat dissipation. In contrast, when the resistance value of high resistance portions 3-*a* other than central portion is made lower than that of the central high resistance portion $(\mathbf{3}\text{-}a)_c$, the central high resistance portion $(\mathbf{3}\text{-}a)_c$ is difficult to blow due to greater heat dissipation. Thus, the clearing (or blowing) characteristics can be controlled by changing the resistance value of high resistance portions 3-*a* other than the central portion positioned symmetrically with regard to the central high resistance portion $(\mathbf{3}\text{-}a)_c$.

[Second modification]

The current protector having the structure as mention above can be modified in that in the form of a chip-type current protector, the electrical conductor is formed on the insulating substrate and covered with a fluorine resin layer having a thickness of preferably 40 to 200 μm.

By modifying as mentioned above, the resulting current protector is further improved in the accuracy for forming the electrical conductor (thickness and width of the conductor).

As the fluorine resin, there can be used those used for forming the insulating substrate. When the thickness of the fluorine resin is less than 40 μm, the protection of the electrical conductor becomes insufficient, while when the thickness is more than 200 μm, it is ineconomical.

The above-mentioned current protector can be produced by the following Processes A and B.

(Process A)

The Process A comprises the steps of:

a. drilling holes for connecting terminals in an organic resin-made insulating substrate on both sides of which metal foils are clad, one of the metal foils having a thickness of 3 to 8 μm.

b. forming a plating resist on portions of the insulating substrate other than portions for forming terminals, c. plating inside of the holes for connecting terminals and the portions for forming terminals to a necessary thickness, d. peeling the plating resist, e. forming an etching resist, f. forming in parallel a plurality of rows of a series of electrical conductors interposing terminals therebetween alternately on one side of the insulating substrate by etching the metal foil having the thickness of 3 to 8 μm, g. covering at least the surfaces of the electrical conductors with a fluorine resin in 40 to 200 μm thickness, and h. cutting the center of the holes for connecting terminals so as to give a number of current protector chips, each chip having conductive terminals at both ends interconnected by the electrical conductor (i.e. a fusible link).

(Process B)

The Process B comprises the steps of:

a. drilling holes for connecting terminals in an organic resin-made insulating substrate on both sides of which metal foils are clad, at least one of the metal foils comprising a first copper layer having a thickness of 10 to 50 μm, an intermediate layer of nickel or nickel alloy having a thickness of 1 μm or less, and a second copper layer having a thickness of 3 to 8 μm, and said second copper layer contacting with the insulating substrate, b. plating inside of the holes for connecting terminals to a necessary thickness, c. removing special portions of a plated layer and the first copper layer, d. removing the intermediate layer to expose the second copper layer, e. forming in parallel a plurality of rows of a series of electrical conductors interposing terminals therebetween alterately one side of the insulating substrate by etching the second copper layer by etching, f. covering at least the surfaces of the electrical conductors with a fluorine resin in 40 to 200 μm, and g. cutting the center of the holes for connecting terminals so as to give a number of current protector chips, each chip having conductive terminals at both ends interconnected by the electrical conductor.

Figure 8:
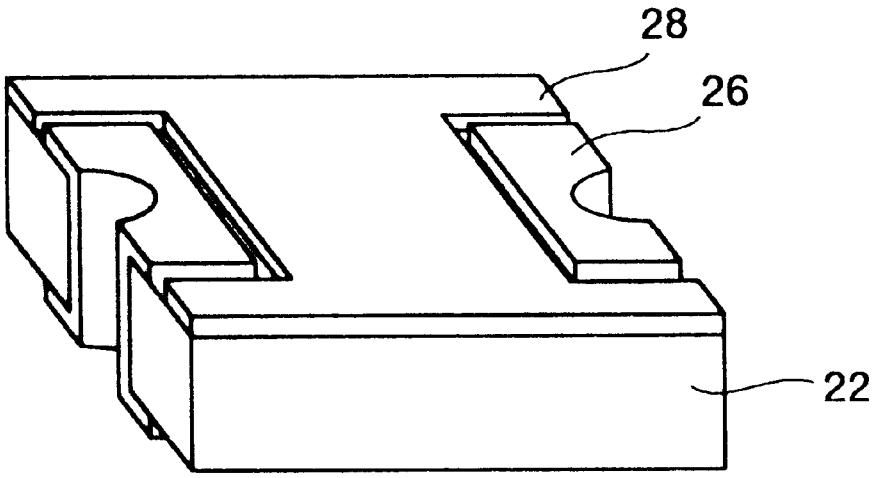
FIG. 8 is a perspective view of one example of chip-type current protector of the present invention.

The resulting current protector chip is shown in FIG. 8, wherein numeral 22 denotes the insulating substrate, numeral 26 denotes a terminal, and numeral 28 denotes the resin layer.

Figure 9:
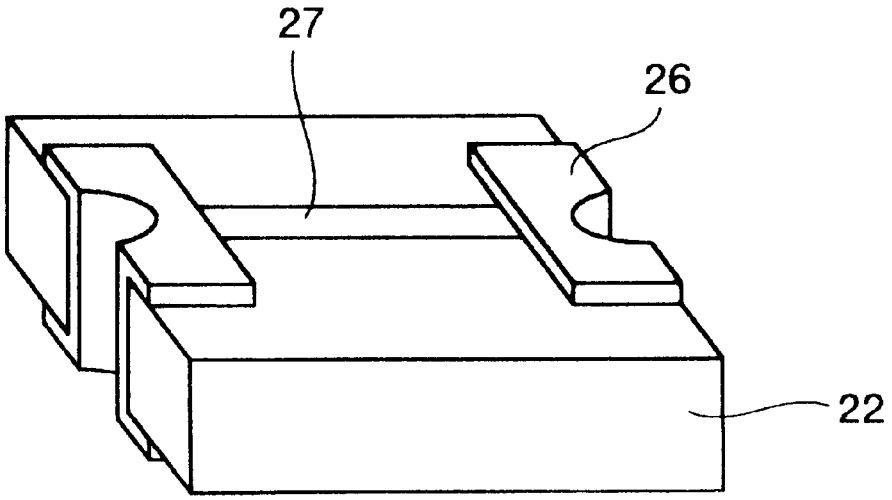
FIG. 9 is a perspective view of the chip-type current protector of FIG. 8 after removing a surface covering resin layer.

FIG. 9 is a perspective view of the current protector chip of FIG. 8 after removing the resin layer 28. In FIG. 9, numeral 27 denotes an electrical conductor (i.e. fusible link).

The fluorine resin layer can be formed by coating, printing or air spraying a suspension or solution of the fluorine resin according to conventional methods. It is also possible to press a fluorine resin film with heating.

By covering the surface of electrical conductor (i.e. fusible link) with the fluorine resin, ignition and smoking of the current protector can be prevented more effectively. That is, the fluorine resin is remarkably incombustible and does not ignite nor burn in the air. Reason for this seems to be derived from the chemical structure of the fluorine resin per se. Since bonding between fluorine and carbon in the molecule is strong, the carbon is hardly eliminated from the molecule singly. Thus, the generation of smoke seems to be suppressed. On the other hand, a part of fluorine resin is decomposed at high temperatures to generate a colorless transparent gas including fluorine atoms by vaporization. Since the heat of vaporization is taken away from surroundings, more damage of the fluorine resin seems to be prevented.

When a resin other than fluorine resin is used in the organic resin-made insulating substrate, such a resin is heated to an extremely high temperature at the blowing of the copper conductor (i.e. fusible link), resulting in generating a large amount of smoke for a long time, for example, several seconds. Thus, such a current protector is insufficient in function. In contrast, when the fluorine resin is used in the insulating substrate, such a problem is solved. On the other hand, the current protector is usually covered with a resin for protection. In a known method, there has been used a silicone resin (rubber), which is insufficient for suppressing smoking and ignition. In the present invention, smoking and generation of spark in the air can be suppressed by using the fluorine resin as a covering material.

[Third modification]

The current protector having the structure as mentioned above can be modified in that in the form of a chip-type current protector, the electrical conductor is formed in the insulating substrate and sandwiched by a pair of light-shielding metal foils.

By modifying as mentioned above, the resulting current protector is further improved in surface appearance as well as prevention of transmittance of light at the time of clearing or blowing.

When the organic resin-made insulating substrate is laminated and adhered to, the fluorine resin used in the insulating substrate is softened again and provides a problem of insufficiency in dimensional accuracy at the production of small-sized chip-type current protectors. In such a case, it is desirable to use a resin having a lower softening point than the resin used in the insulating substrate on which an electrical conductor is formed and to conduct lamination and adhesion at a temperature at which the dimensional accuracy is allowable. As the adhesive for such a purpose, there can be used a tetrafluoroethylene-ethylene copolymer which is relatively cheap, and polytetrafluoroethylene which has a lower molding temperature. More concretely, by using polytetrafluoroethylene as the insulating substrate and a tetrafluoroethylene-ethylene copolymer as the adhesive, the above-mentioned purpose can be attained.

As the light-shielding metal foil, there can be used conventional materials so long as the ignition, smoking and light at the time of blowing under over-current conditions can be prevented or shielded. The thickness and size of the light-shielding metal foil can be determined depending on the purpose and easiness of production, preferably 5 to 50 $\mu$m in thickness and larger in size so long as not contacting with the terminals.

The above-mentioned current protector can be produced by the following Processes C and D.

(Process C)

The Process C comprises the steps of:

a. forming an article having electrical conductors which are formed by etching one of metal foils clad on both sides of an insulating substrate, b. laminating the article having electrical conductors, a fluorine resin-made prepreg or a fluorine resin-made film, and a metal foil, followed by adhesion so as to have the metal foils at the outmost surfaces, c. removing the metal foils of the resulting laminate except for special portions by etching to form light-shielding metal foil portions, d. laminating the etched article, a fluorine resin-made prepreg or a fluorine resin-made film, and a metal foil, followed by adhesion so as to have the metal foils at the outmost surfaces, e. drilling holes for connecting terminals, f. conducting plating so as to have conductors in the holes for connecting terminals, g. forming conductive terminals by etching, and h. cutting the center of the holes for connecting terminals so as to give a number of current protector chips, each chip having conductive terminals at both ends interconnected by the electrical conductor (i.e. a fusible link).

(Process D)

The Process D comprises the steps of:

a. forming an article having electrical conductors on one side by etching of one of metal foils clad on an insulating substrate, followed by formation of a light-shielding metal foil on another side of the article, b. forming a light-shielding metal foil by etching one of metal foils clad on another insulating substrate to give an insulating substrate having a light-shielding metal foil on one side, c. laminating a metal foil, the article having the light-shielding metal foil on one side and the electric conductors on another side, and a fluorine resin-made prepreg on a fluorine resin-made film, and the insulating substrate having the light-shielding metal foil on one side, followed by adhesion so as to have the metal foils at the outmost surfaces, d. drilling holes for connecting terminals in the resulting laminate, e. conducting plating so as to have conductors in the holes for connecting terminals, f. forming conductive terminals by etching, and g. cutting the center of the holes for connecting terminals so as to give a number of current protector chips, each chip having conductive, terminals at both ends interconnected by the electrical conductor (i.e. a fusible link).

Figure 11:
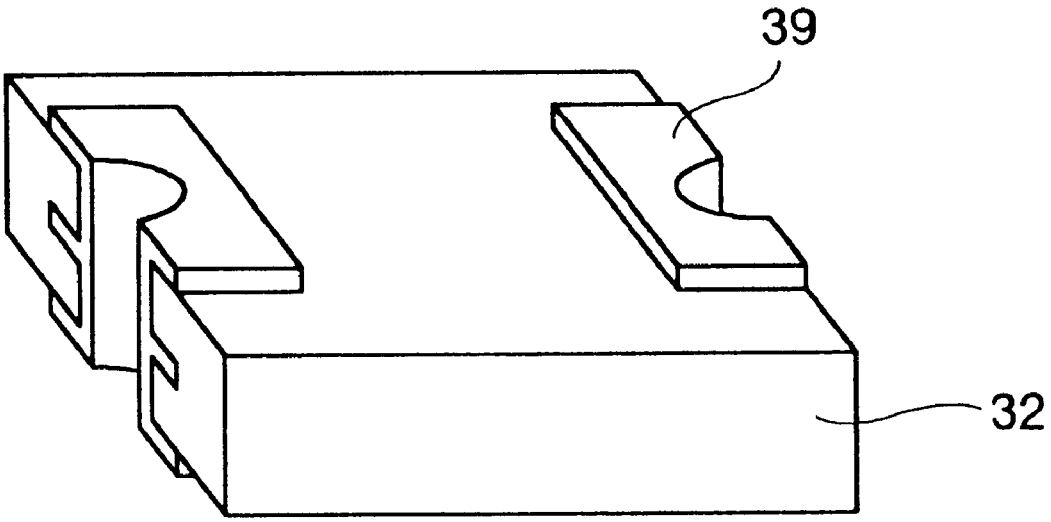
FIG. 11 is a perspective view of one example of the current protector produced by the steps shown in FIGS. 10A to 10I.

The resulting current protector chip is shown in FIG. 11, wherein numeral 32 denotes the insulating substrate, and numeral 39 denotes a conductive terminal.

When the electrical conductor has the thickness of 3 to 8 $\mu$m, there is a problem in that cracks are easily produced at boundary between the connecting portion of terminal and the electric conductor due to thermal stress. Thus, when the current protector is used under circumstances with a large temperature difference, it is desirable to make the thickness of the conductive terminal connecting to the electrical conductor 10 $\mu$m or more by partial plating or the like. But too thick terminals cause an increase of production cost and poor moldability at the time of lamination, followed by adhesion. Thus, the thickness can be 50 $\mu$m at most.

According to the third modification, the light-shielding metal foils sandwich the electric conductor (i.e. fusible link), so that ignition and smoking under over-current conditions can be prevented effectively by the light-shielding metal foils. When a fluorine resin is used in the insulating substrate, since the electrical conductor is buried in the insulating substrate, the current protector is hardly damaged and hardly generates smoke.

Heretofore, when the covering resin layer is thin, e.g. less than 50 $\mu$m, or when a fine organic foreign body adheres even if the covering resin layer is 50 $\mu$m or more, there is a problem of damaging of the covering resin layer. Further, when the applied voltage is high, light emission caused by spark due to electric discharge in the insulating substrate is observed through the insulating substrate or covering resin layer, resulting in causing a problem of poor surface appearance.

According to the present invention, since the light-shielding metal foils are used in the current protector, the above-mentioned problems are solved.

[Fourth modification]

The current protector having the structure as mentioned above can be modified in that in the form of a chip-type current protector, the insulating substrate is made from a fluorine resin, and when the electrical conductor is formed on the insulating substrate, it is covered with a fluorine resin.

By the modification as mentioned above, the resulting current protector is further improved in accuracy for forming electrical conductors (thickness and width of electrical conductors) and reliability for a long period of time even under circumstances having a large temperature change.

The above-mentioned current protector can be produced by the following Processes E to H.

(Process E)

The Process E comprises the steps of:

a. forming a plurality of electrical conductors by etching one of metal foils clad on both sides of a fluorine resin-made insulating substrate, said metal foil to be etched having a thickness of 3 to 8 μm, b. laminating an article having the electrical conductors thereon, a fluorine resin-made prepreg or a fluorine resin-made film, and a metal foil, followed by adhesion, c. drilling holes for connecting terminals, d. conducting plating so as to have conductors in the holes for connecting terminals, e. forming conductive terminals by etching, and f. cutting the center of the holes for connecting terminals so as to give a number of current protector chips, each chip having conductive terminals at both ends interconnected by the electrical conductor (i.e. a fusible link).

(Process F)

The Process F comprises the steps of:

a. forming a fluorine resin-made insulating substrate on both sides of which metal foils are clad, at least one of the metal foils comprising a first copper layer having a thickness of 10 to 50 μm, an intermediate nickel or nickel alloy layer having a thickness of 1 μm or less, and a second copper layer having a thickness of 3 to 8 μm, said second copper layer contacting with the insulating substrate, b. etching the special portion of the first copper layer, c. removing the intermediate layer to expose the second copper layer, d. forming a plurality of electrical conductors on one side of the insulating substrate by etching the second copper layer, e. laminating an article having the electric conductors thereon, a fluorine resin-made prepreg or fluorine resin-made film, and a metal foil, followed by adhesion, f. drilling holes for connecting terminals, g. conducting plating so as to have conductors in the holes for connecting terminals, h. forming conductive terminals by etching, and i. cutting the center of the holes for connecting terminals so as to give a number of current protector chips, each chip having conductive terminals at both ends interconnected by the electrical conductor (i.e. a fusible link).

(Process G)

The Process G comprises the steps of:

a. drilling holes for connecting terminals in a fluorine resin-made insulating substrate on both sides of which metal foils are clad, one of the metal foils having a thickness of 3 to 8 μm, b. forming a plating resist on portions of the insulating substrate other than portions for forming conductive terminals, and plating the conductive terminals and inside of the holes to a necessary thickness, c. forming a plurality of electric conductors on one side of the insulating substrate by etching the metal foil having the thickness of 3 to 8 μm formed on the laminate, d. covering the surface of electric conductors with a fluorine resin layer, and e. cutting the center of the holes for connecting terminals so as to give a number of current protector chips, each chip having conductive terminals at both ends interconnected by the electrical conductor (i.e. a fusible link).

(Process H)

The Process H comprises the steps of:

a. drilling holes for connecting terminals in a fluorine resin-made insulating substrate on both sides of which metal foils are clad, at least one of the metal foils comprising a first copper layer having a thickness of 10 to 50 μm, an intermediate layer of nickel or nickel alloy having a thickness of 1 μm or less, and a second copper layer having a thickness of 3 to 8 μm, said second copper layer contacting with the insulating substrate, b. plating inside of the holes for connecting terminals to a necessary thickness, c. etching special portions of the plating layer and the first copper layer, d. removing the intermediate layer to expose the second copper layer, e. forming a plurality of electrical conductors on one side of the fluorine resin-made insulating substrate by etching the second copper layer, f. covering the surfaces of electric conductors with a fluorine resin layer, and g. cutting the center of the holes for connecting terminals so as to give a number of current protector chips, each chip having conductive terminals at both ends interconnected by the electrical conductor.

Figure 13A:
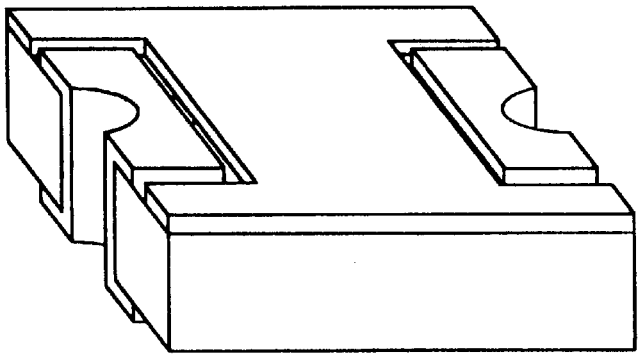
FIGS. 13A to 13C are perspective views of examples of chip-type current protectors of the present invention.
Figure 13B:
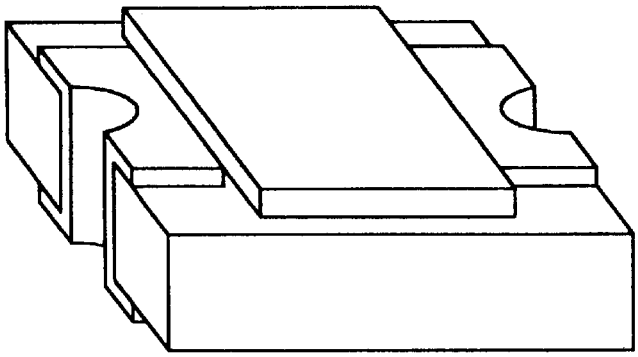
Figure 13C:
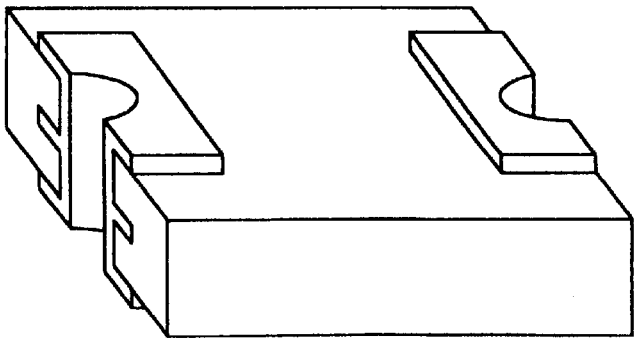

The resulting current protectors can be shown by FIGS. 13A to 13C.

According to prior art processes, electrical conductors are formed by a thick film method or a plating method. The thick film method includes a pattern printing method wherein the conductors are directly formed by a thick film obtained by screen printing; and a thick film etching method wherein after printing the whole surface, conductors are formed by etching. According to the pattern printing method, it is difficult to form fine patterns and uniform thickness. According to the thick film etching method, the accuracy of thickness is improved considerably but the thickness in the substrate varies considerably. Further, the accuracy is further lowered by etching.

On the other hand, the plating method includes a panel plating method wherein after conducting electric plating on the whole surface of an insulating substrate, electrical conductors are formed by etching; a pattern plating method wherein after conducting underlying plating of ultra-thin film, a pattern is formed by electro plating; and a full additive method wherein the conductors are formed by electroless plating. According to the panel plating method and the pattern plating method, it is difficult to control the scattering of the thickness in the substrate within 20%. According to the full additive method, the thickness accuracy is satisfactory but the working time is long and complicated control is necessary in order to increase the thickness accuracy.

In contract, according to the present invention, since the ultra-thin copper film or composite metal foil, each having a predetermined thickness, is used, the sufficient accuracy can be obtained without suffering from the problems of prior art mentioned above. Further, the change of thickness of metal foils between lots or within a lot is very small, resulting in improving the etching accuracy and the accuracy of the conductor width. By such effects, scattering of resistance values becomes small, resulting in providing current protectors having excellent clearing characteristics with small scattering of clearing characteristics under overcurrent conditions.

Further, since it is not necessary to control the thickness of electrical conductors depending on changes in working conditions, the yield can be improved, resulting in lowering the production cost.

In addition, since the fluorine resin is used in the insulating substrate and in the covering resin layer, the same advantages as explained in the second and third modifications can be obtained.

[Fifth modification]

The current protector having the structure as mentioned above can be modified in that in the form of a chip-type current protector, a vacant space is formed between the electrical conductor and the resin layer placed thereon.

By the modification as mentioned above, the resulting current protector is further improved in insulating resistance after blowing or clearing.

When the electrical conductor is formed in the insulating substrate, the vacant space is formed between the electrical conductor and the resin layer contacting with the electrical conductor.

When the electrical conductor is formed on the insulating substrate, the vacant space is formed between the electrical conductor and the resin layer covering the surface of the electrical conductor.

The volume of the vacant space is sufficient when the vacant space can be formed by the swell of the resin layer.

The above-mentioned current protector can be produced by the following Processes I to J.

(Process I)

The Process I comprises as follows. In a process for producing a chip-type current protector wherein electrical conductor is covered with a resin, or a resin and a reinforcing material, a vacant space is formed by passing a predetermined amount of current for a predetermined time through the electrical conductor between the electrical conductor and the overlying resin layer.

(Process J)

The Process J comprises the steps of:

a. drilling holes for connecting terminals in an insulating substrate having metal foils on both sides thereof, b. conducting plating in the holes to a necessary thickness, c. forming a plurality of electrical conductors on one side of the insulating substrate by etching one of the metal foils, d. covering the surfaces of electrical conductors with a resin layer, and e. cutting the center of the holes for connecting terminals so as to give a number of current protector chips, each chip having conductive terminals at both ends interconnected by the electrical conductor (i.e. a fusible link).

(Process K)

The Process K comprises the steps of:

a. forming an article having electrical conductors which are formed by etching one of metal foils clad on both sides of an insulating substrate, b. laminating the article having electrical conductors, a fluorine resin-made prepreg or a fluorine resin-made film, and a metal foil, followed by adhesion so as to have the metal foils at the outmost surfaces, c. drilling holes for connecting terminal in the resulting laminate, d. conducting plating so as to make conductors in the holes for connecting terminals, e. forming conductive terminals by etching, and f. cutting the center of the holes for connecting terminals so as to give a number of current protector chips, each chip having conductive terminals at both ends interconnected by the electrical conductor (i.e. a fusible link).

Figure 15:
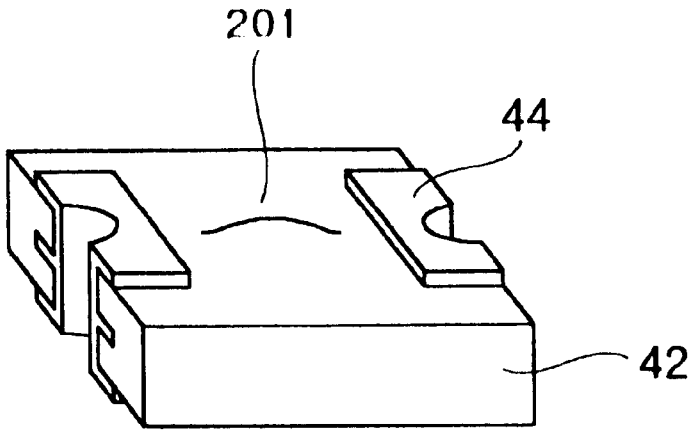
FIG. 15 is a perspective view showing an example of chip-type current protector produced by the steps shown in FIGS. 14A to 14J.
Figure 16:
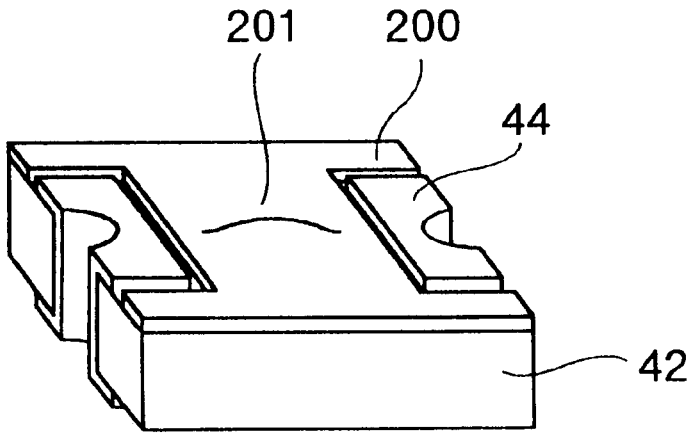
FIG. 16 is a perspective view showing another example of chip-type current protector of the present invention.

The resulting current protector chip is shown in FIGS. 15 and 16, wherein numeral 42 denotes an insulating substrate, numeral 44 denotes a conductive terminal, numeral 200 denotes a resin layer covering the surface, and numeral 201 denotes swelling.

The resin layer can be formed in the same manner as described in the second modification.

After this, the electric conductor is heated by passing an electric current therethrough to generate swelling of the covering resin layer. When the current value is too small, the necessary swelling does not take place, while the current value is too large, the electrical conductor blows. Therefore, it is preferable to pass an electric current so as to bring about the necessary swelling (preferably about 3 times as large as the rated electric current for 0.01 second or less) in several ten seconds and to have a sufficient time until blowing. Such a current changes depending on the kind of material, and thickness of the covering resin layer and the kind of material of the insulating substrate.

In the present invention, the vacant spaces can be formed between both the upper and lower resin layers and the electrical conductor.

The thickness of the conductive terminals and boundary portions between the conductive terminal and the electrical conductor is described in the third modification.

According to the fifth modification, insulating properties after blowing are improved by forming the vacant spaces, in other words, by preventing adhesion of the covering resin layer from the electrical conductor by forming swelling of the resin layer.

By forming the vacant spaces produced by swelling of the resin layer, the insulating resistance after blowing can be improved by (1) the covering resin layer is not directly exposed to the high temperature at the time of blowing, (2) the generation of carbonized product can be suppressed by the generation of carbon dioxide by the diffusion of oxygen in the air into the swelled portion, and (3) fine particles or evaporated product of metal diffuses into the swelled portion, resulting in reducing the residual amount in the blowed portion.

In addition, the damage of the current protector can also be reduced effectively by not contacting directly with the blowed portion of the current protector by providing swelling to the covering resin layer.

Needless to say, by using the fluorine resin in the insulating substrate and in the covering resin layer, the same advantages as described in the second, third and fourth modifications can be obtained.

[Sixth modification]

The current protector having the structure as mentioned above can be modified in that in the form of a chip-type current protector, the electrical conductor is formed in the insulating substrate and a vacant space is formed at least a portion around the electrical conductor to be blowed.

By modifying as mentioned above, the resulting current protector is further improved in accuracy for forming electrical conductors (thickness and width of electrical conductors) and reliability for a long period of time, and is high in insulation resistance after blowing.

The above-mentioned current protector can be produced by the following Processes L and M.

(Process L)

The Process L comprises the steps of:

a. forming a plurality of electrical conductors by etching one of metal foils clad on both sides of an organic resin-made insulating substrate, said metal foil to be etched having a thickness of 3 to 8 μm, b. forming another insulating substrate having holes for forming vacant spaces in predetermined places, c. laminating the insulating substrate having a plurality of electrical conductors, the insulating substrate having holes for forming vacant spaces, and an insulating substrate having a metal foil on one side thereof so as to adjust the position of the holes for forming vacant spaces and the electrical conductors, followed by adhesion, d. forming holes for connecting terminals in the resulting laminate, e. conducting plating so as to form conductors in the holes for connecting terminals, f. forming conductive terminals by etching, and g. cutting the center of the holes for connecting terminals so as to give a number of current protector chips, each chip having conductive terminals at both ends interconnected by the electrical conductor (i.e. a fusible link).

(Process M)

The Process M comprises the steps of:

a. forming an organic resin-made insulating substrate on both sides of which metal foils are clad, at least one of the metal foils comprising a first copper layer having a thickness of 10 to 50 μm, an intermediate nickel or nickel alloy layer having a thickness of 1 μm or less, and a second copper layer having a thickness of 3 to 8 μm, said second copper layer contacting with the insulating substrate, b. removing the first copper layer, c. removing the intermediate layer to expose the second copper layer, d. forming a plurality of electrical conductors on one side of the insulating substrate by etching the second copper layer, e. forming another insulating substrate having holes for forming vacant spaces in predetermined places, f. laminating the insulating substrate having a plurality of electrical conductors, the insulating substrate having holes for forming vacant spaces, and an insulating substrate having a metal foil on one side thereof so as to adjust the position of the holes for forming vacant spaces and the electrical conductors, followed by adhesion, g. drilling holes for connecting terminals in the resulting laminate, h. conducting plating so as to form conductors in the holes for connecting terminals, i. forming conductive terminals by etching, and j. cutting the center of the holes for connecting terminals so as to give a number of current protector chips, each chip having conductive terminals at both ends interconnected by the electrical conductor (i.e. a fusible link).

The resulting current protector chip has an appearance as shown in FIG. 11.

The adhesion of the insulating substrate having holes for forming vacant spaces with other materials can be carried out, for example, by binding another insulating substrate with an insulating substrate having holes for forming vacant spaces and formed thereon a material having a lower softening point, or placing a resin film having a thickness of 3 to 30 μm, preferably 5 to 15 μm and a softening temperature lower than that of an insulating substrate having holes between the insulating substrate having holes and another insulating substrate, followed by adhesion by the action of the inserted resin film. The above-mentioned two methods can be combined. That is, the material having a lower softening point is formed on the insulating substrate having the holes, and another insulating substrate is placed thereon via the resin film, followed by adhesion. In the latter case, the desirable thickness range mentioned above means the total thicknesses of the material having the lower softening point and the resin film. In the case of lamination with adhesion using the resin film, the resin film acts as a protective layer for the current protector, since the resin film covers the electrical conductors (i.e. fusible links).

In the lamination with adhesion, it is preferable to use polytetrafluoroethylene as the insulating material and a tetrafluoroethylene-ethylene copolymer having a lower softening point than polytetrafluoroethylene as the adhesive, from the viewpoint of lowering the laminating and adhering temperature and reducing thermal stress in the laminate.

In the sixth modification, the vacant space is formed on or around the electrical conductor (i.e. fusible link). The vacant space can hold air containing oxygen around the electrical conductor. When over-current passes, the generated heat oxidizes the electrical conductor rapidly to blow the conductor (fusible link). Further, when the air is present, the fluorine resin hardly produces a carbonized product, even if heated. Thus, an incombustible gas seems to be produced. When a fuse is heated in an airless state, i.e. in a fluorine resin, a carbonized product is formed from the fluorine resin. According to the sixth modification, the production of carbonized products can be prevented by the air held in the vacant space, and insulation resistance after blowing can be maintained at a sufficient high level. Thus, the current protector is very effective when high reliability of current protector is required.

On the other hand, when a small amount of ambient substances such as vapor, sulfurous acid gas is included in the vacant space, for example, by penetration from interface of the substrate, the electrical conductor is eroded, resulting in changing the resistance value with the lapse of time, causing scattering of clearing characteristics. In such a case, the insertion of the resin film is recommended.

[Seventh modification]

The current protector having the structure as mentioned above can be modified in that in the form of a chip-type current protector, the electrical conductor has a space or a non-adhesion portion with regard to the underlying insulating substrate.

By modifying as mentioned above, the resulting current protector is further improved in accuracy for forming electrical conductors (thickness and width of electrical conductors) and reliability for a long period of time, and is high in insulation resistance after blowing.

The above-mentioned current protector can be produced by the following Processes N and P.

(Process N)

The Process N comprises the steps of:

a. forming a plurality of electrical conductors by etching one of metal foils clad on both sides of an organic resin-made insulating substrate, said metal foil to be etched having a thickness of 3 to 8 μm, b. laminating the insulating substrate having electrical conductors thereon, an insulating material, and a metal foil, or laminating the insulating substrate having electrical conductors thereon and a metal foil-clad insulating material, and pressing for adhesion the laminated materials using a plate having holes so as not to press the special portions, c. drilling holes for connecting terminals in the resulting laminate, d. conducting plating so as to form conductors in the holes for connecting terminals, e. forming conductive terminals by etching, and f. cutting the center of the holes for connecting terminals so as to give a number of current protector chips, each chip having conductive terminals at both ends interconnected by the electrical conductor.

(Process P)

The Process P comprises the steps of:

a. forming an organic resin-made insulating substrate on both sides of which metal foils are clad, at least one of the metal foils comprising a first copper layer having a thickness of 10 to 50 μm, an intermediate nickel or nickel alloy layer having a thickness of 1 μm or less, and a second copper layer having a thickness of 3 to 8 μm, said second copper layer contacting with the insulating substrate, b. removing the first copper layer, c. removing the intermediate layer to expose the second copper layer, d. forming a plurality of electric conductors on one side of the insulating substrate by etching the second copper layer, e. laminating the insulating substrate having electrical conductors thereon, an insulating material, and a metal foil, or laminating the insulating substrate having electrical conductors thereon and a metal foil-clad insulating material, and pressing for adhesion the laminated materials using a plate having holes so as not to press the special portions, f. drilling holes for connecting terminals in the resulting laminate, g. conducting plating so as to form conductors in the holes for connecting terminals, h. forming conductive terminals by etching, and i. cutting the center of the holes for connecting terminals so as to give a number of current protector chips, each chip having conductive terminals at both ends interconnected by the electrical conductor.

The resulting current protector chip has an appearance as shown in FIG. 15.

The adhesion of the insulating substrate having electrical conductors thereon with other insulating materials can be carried out by re-softening and melt-bonding of the fluorine resin used in the insulating substrate. It is also possible to insert a resin film having a lower softening point between the insulating substrate having the electrical conductors thereon and the other insulating materials and to conduct adhesion by this resin film. In this case, when the thickness of the resin film is too thick, there often takes place a phenomenon of adhesion due to a flow of the resin even in the portions not intended for adhesion without pressing the special portions at the time of lamination and adhesion. In order to prevent such a phenomenon, it is preferable to use the resin film having a thickness of 30 μm or less, more preferably 15 μm or less, and 5 μm or more, considering availability.

When the insulating substrate having electrical conductors thereon is bonded via a material having a lower softening point in order to improve the dimensional accuracy for small-sized chips, it is preferable to use polytetrafluoroethyren as the insulating material and a tetrafluoroethylene-ethylene copolymer as an adhesive resin.

In the seventh modification, the electrical conductors are kept from adhesion. Thus, it is possible to maintain air containing oxygen around the electrical conductor, resulting in oxidizing the fusible link (electrical conductor) rapidly to blow by the generated heat in the case of passing overcurrent. Further, when the air is present, the fluorine resin hardly produces a carbonized product even if heated, and an incombustible gas seems to be produced. Thus, the clearing characteristics become sensitive.

The present invention is illustrated by the following Examples.

In the Examples, the clearing test, the heat cycle test and measurement of resistance value were conducted as follows.

[Clearing Test]

A rated current source, a resistance R (1–2 Ω) for measuring a current and a current protector to be measured were connected in series and both sides of the resistance were connected to an oscilloscope. After switching on the rated current source, wave forms were observed and a time of blowing (R) of the current protector was read on from the time scale (abscissae axis) of the oscilloscope.

The current of this time was obtained by reading on the height of wave V from the voltage scale (ordinate axis) of the oscilloscope and calculating the following formula:

$$I(\text{current})=V/R$$

[Heat cycle test]

Condition 1: −40° C. for minutes condition 2: 125° C. for minutes

After repeating the predetermined times (cycles) of Condition 1 and Condition 2 alternately, the thus treated sample was subjected to the measurement of a resistance value, which value was compared with the initial resistance value.

[Measurement of resistance value]

A resistance value was measured by a so-called four terminal method. On an insulating substrate, both ends of a current protector to be measured were held between two metal rods standing on with the same distance as that of the terminals, and the two metal rods were held between probes for measuring. Then, a resistance value was measured. One probe was combined with two terminals while insulated, and a current was passed through one sample, while a voltage was measured in another sample. The current for measuring was 1 to 10 mA.

EXAMPLE 1

This Example is explained referring to FIGS. 3A to 3H.

Figure 3A:
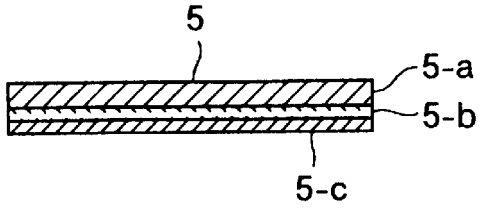
FIGS. 3A to 3H are cross-sectional views (FIGS. 3A to 3F, and 3H) and a top plan view (FIG. 3G) for explaining the steps for producing the current protector of Example 1 of the present invention.

A metal foil 5 having a three layer structure as shown in FIG. 3A was prepared. In FIG. 3A, numeral 5-*a* denotes a first copper layer having a thickness of 15 μm, numeral 5-*b* denotes an intermediate layer of Ni—P alloy having a thickness of 0.2 μm, and numeral 5-*c* denotes a second copper layer having a thickness of 5 μm.

Figure 3B:
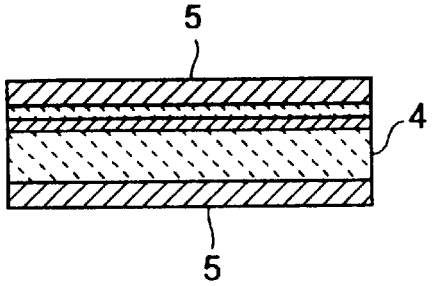

A substrate 4 was prepared by bonding the metal foil 5 to the substrate 4 so as to contact the second copper layer 5-*c* to the substrate and also bonding a copper foil 5 having a thickness of 18 μm on the other side as shown in FIG. 3B.

A glass cloth-reinforced fluorine resin prepreg was used as a material for the substrate 4, and pressed under a pressure of 20 kgf/cm$^2$ at 385° C. for 90 minutes for adhesion.

Figure 3C:
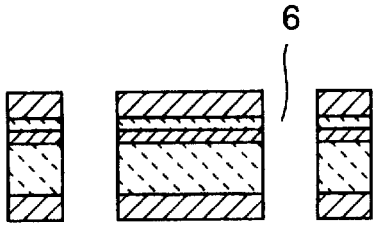
Figure 3D:
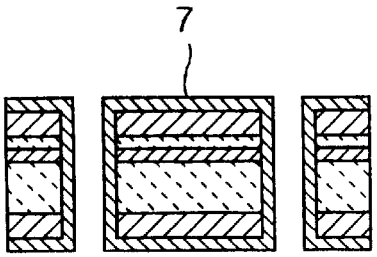

Then, as shown in FIG. 3C, holes 6 with a diameter of 0.8 mm were drilled, and electroless plating was carried out to give conductors 7 having a thickness of 15 μm as shown in FIG. 3D.

After forming the copper plating coating 7, lands 2 to be formed into conductive terminals and having a diameter of 1.2 mm were formed around the holes 6.

A photosensitive resist film 8 was laminated on the whole surfaces of the substrate 4 forming the copper plating coating 7, and a negative film (not shown in the drawings) for forming lands was adhered thereto, followed by exposure to light for curing.

After removing the negative film, uncured portions of the photosensitive resist film were removed by development to form the resist film 8.

Figure 3E:
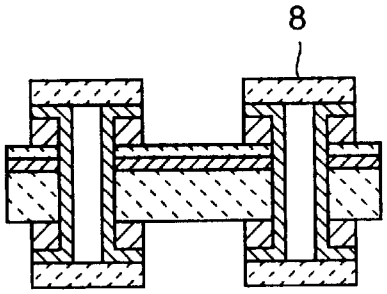

Then, as shown in FIG. 3E, the first copper layer 5-*a* (copper plated in 15 μm thick) and the copper layer 5 of 18 μm other than the land portion of the resist film 8 were removed using an alkaline etching solution.

Figure 3F:
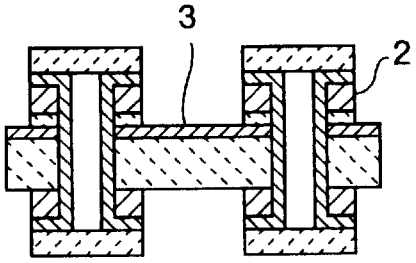

Then, the intermediate layer of Ni—P alloy 5-*b* was removed by etching using an etching solution containing nitric acid and hydrogen peroxide as major component as shown in FIG. 3F. Then, the cured photosensitive resist film 8 was peeled using a 5% by weight NaOH solution to form lands 2 which is to be formed into terminals.

Figure 3G:
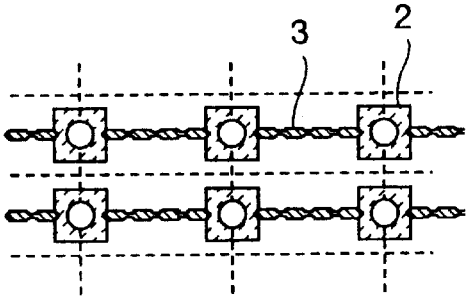

Then, a pattern 3 for current protector was formed. A photosensitive film 8 was laminated using a laminator. Then, a negative film (not shown in the drawings) having transparent portions which have the same shape as the pattern was adhered thereon, followed by exposure to light. After removing the negative film, development, removal with etching, and peeling of the resist film were carried out to form the conductor pattern 3 on the substrate as shown in FIG. 3G.

Figure 3H:
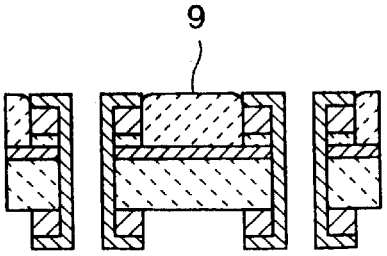

Then, on the thus formed conductor pattern 3 and upper exposed surface of the substrate 4, a silicone resin (SE-1700, a trade name, mfd. by Toray Dow Corning Co.) was coated in 60 μm thickness and cured in an oven at 130° C. for 15 minutes to form a silicone protective film 9 as shown in FIG. 3H.

The resulting substrate was cut with a diamond cutter at the center of the hole 6 so as to give individual current protector chips.

The current protector chips had a resistance value of about 190 to 210 mΩ, with scattering of the resistance value within 10%. The blowing (clearing) times at the same current value was distributed within 10%.

EXAMPLE 2

Figure 4A:
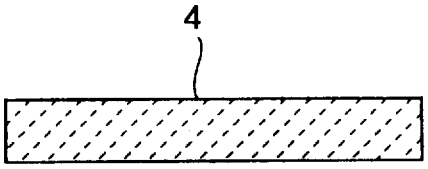
FIGS. 4A to 4H are cross-sectional views (FIGS. 4A to 4F and 4H) and a top plan view (FIG. 4G) for explaining the steps for producing the current protector of Example 2 of the present invention.

A substrate 4 as shown in FIG. 4A was prepared by removing copper layers by etching the whole surfaces of a glass cloth-reinforced fluorine resin substrate.

Figure 4B:
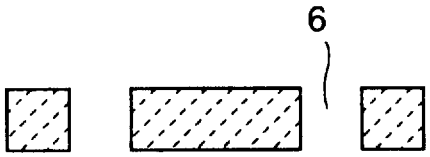

Holes 6 having a diameter of 0.8 mm were drilled as shown in FIG. 4B, followed by lamination of a photosensitive resist film 8 on both sides of the substrate, adhesion of positive type film (not shown in the drawing) for forming lands around the holes 6 on both sides, exposure to light and curing.

Figure 4C:
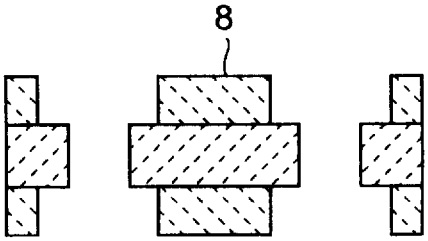

Then, development was conducted to form a resist film 8 as shown in FIG. 4C.

Figure 4D:
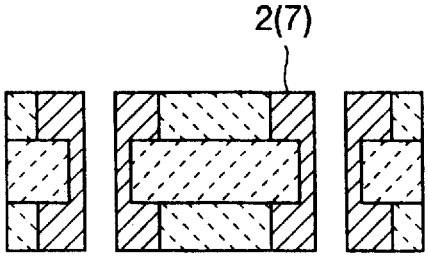

After forming the resist film 8, electroless plating was carried out using the following composition under the following conditions to form lands 2 as shown in FIG. 4D, wherein numeral 7 denotes an electroless plated coating:

| | |
|---|---|
| $CuSO_4.5H_2O$ | 10 g/l, |
| EDTA.4Na | 40 g/l, |
| pH | 12.3 |
| 37% $CH_2O$ | 3 ml/l, |
| Additives for plating solution | a small amount |
| Temperature of plating solution | 70° C. |
| Thickness of plated film | 5 μm |

After peeling the resist film 8, a photosensitive resist 8 was laminated on both sides of the substrate 4 again. On one side, a positive type film for the pattern (not shown in the drawing) was adhered between the lands, and on the other side, a film capable of exposed to light (not shown in the drawing) was adhered on the whole surface, followed by exposure to light.

Figure 4E:
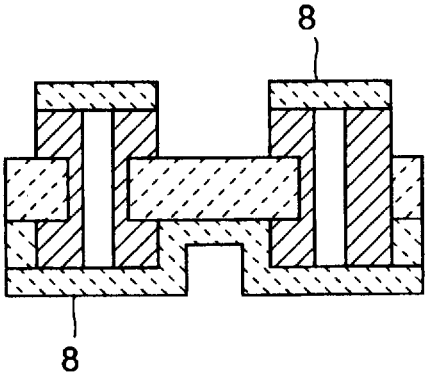

After carrying out development, resist films 8 as shown in FIG. 4E were formed.

Figure 4F:
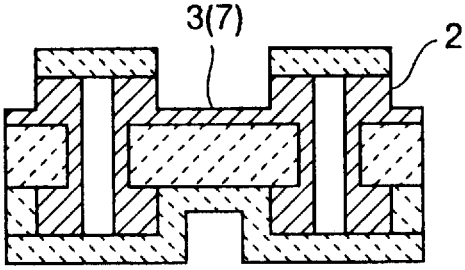
Figure 4G:
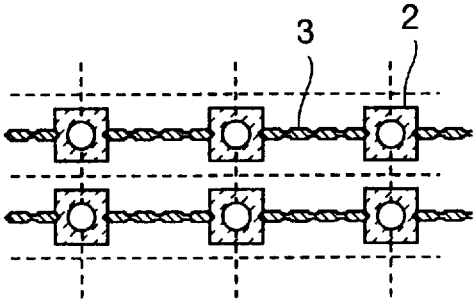

After forming the resist film 8, the conductor pattern 3 as shown in FIGS. 4F and 4G were formed under the same electroless plating conditions as described in Example 1.

Figure 4H:
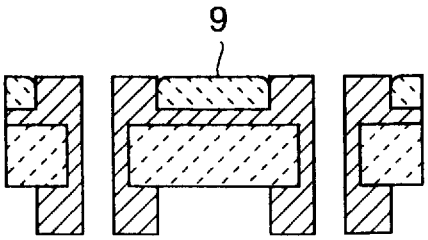

After copper plating, the photosensitive resist film 8 was removed in the same manner as described in Example 1, followed by formation of a silicone protective film 9 on the upper portion of the pattern formed surface as shown in FIG. 4H. Current protector chips were obtained after cutting using a diamond cutter as described in Example 1.

The resulting current protector chips showed the same resistance values and clearing characteristics as in Example 1.

The resulting current protectors blow at the central high resistance portion under over-current without fail, so that there can be obtained current protectors having very stable clearing characteristics. Further, since the blowing takes place only at the central high resistance portion having a small area, damages of the substrate are small and there is no smoking.

Further, since the clearing characteristics can be controlled only by changing the resistance values of high resistance portions other than the central high resistance portion, current protectors for low rated urrent type can easily be designed.

EXAMPLE 3

Figure 6A:
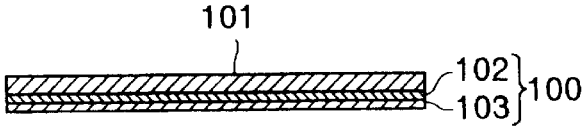
FIGS. 6A to 6I are cross-sectional views (FIGS. 6A to 6F, and 6I) and top plan views (FIGS. 6G and 6H) for explaining the steps for producing one example of chip-type current protector of the present invention.

A composite metal foil having a three-layer structure 100 as shown in FIG. 6A was prepared. In FIG. 6A, numeral 101 denotes a first copper layer having a thickness of 15 μm, numeral 102 denotes an intermediate layer of Ni—P alloy having a thickness of 0.2 μm, and numeral 103 denotes a second copper layer having a thickness of 5 μm. Such a composite metal foil is disclosed in U.S. Pat. No. 5,403,672.

Figure 6B:
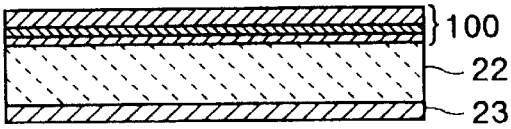

The composite metal foil was bonded to an insulating substrate 22 so as to contact the second copper layer to the insulating substrate and a copper foil 23 of 18 μm thick was bonded to another side of the insulating substrate as shown in FIG. 6B.

As the material for the insulating substrate, glass cloth-reinforced polytetrafluoroethylene prepreg was used. The pressing was conducted at 380° C. for 90 minutes under a pressure of 20 kgf/cm$^2$.

Figure 6C:
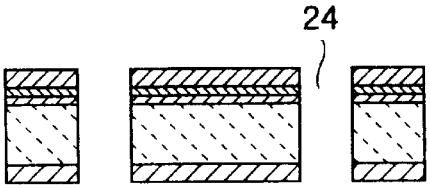
Figure 6D:
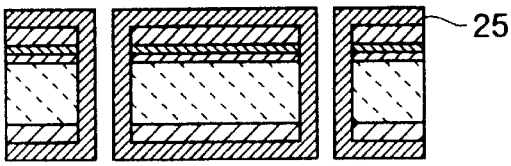

Holes 24 for connecting terminals were drilled as shown in FIG. 6C and plating was carried out to form plated coating 25 of 15 μm thick as shown in FIG. 6D.

Figure 6E:
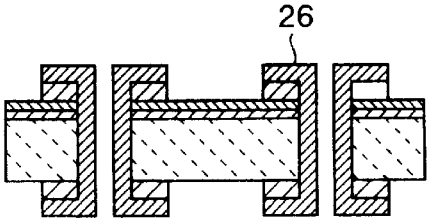

The first copper layer (and the previously plated coating) except for the portions to be formed into terminals was removed as shown in FIG. 6E using an alkaline etching solution (an A-Process, a trade name, mfd. by Meltex Inc.) to form terminal portions 26.

Figure 6F:
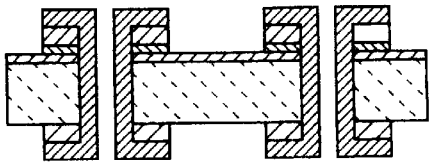

Then, as shown in FIG. 6F, using an etching solution having nitric acid and hydrogen peroxide as major components, the intermediate Ni—P alloy layer exposed by the etching of the first copper layer was removed.

Figure 6G:
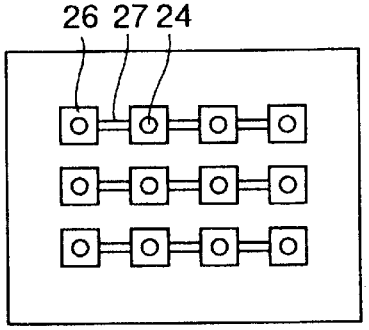

Then, the second copper layer was etched so as to form in parallel a plurality of rows of a series of electrical conductors interposing terminals therebetween alternately (FIG. 6G).

Figure 6H:
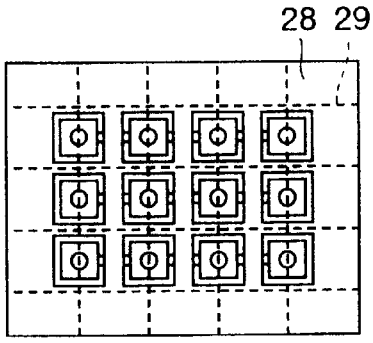
Figure 6I:
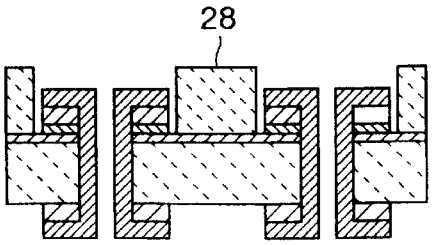

On the surface of the thus treated substrate, a polytetrafluoroethylene film (Nitoflon film, a trade name, mfd. by Nitto Electric Industrial Co., Ltd.) having a thickness of 100 μm and also having holes in the portions corresponding to terminals was laminated and pressed at 380° C. for 30 minutes under a pressure of 20 kgf/cm$^2$ (see FIGS. 6H and 6I). In FIGS. 6G to 6I, numeral 27 denotes the electrical conductor, numeral 28 denotes the resin film, and numeral 29 denotes cutting lines for individual current protector chips.

EXAMPLE 4

Using the same materials and steps as described in Example 3, electrical conductors were formed.

On the surface of the resulting substrate, a film of tetrafluoroethylene-perfluoroalkoxyethylene copolymer having a thickness of 50 μm (Afron PFA, a trade name, mfd. by Asahi Kasei Kogyo K.K.) was laminated and pressed at 340° C. for 30 minutes under a pressure of 20 kgf/cm$^2$.

Comparative Example 1

The process of Example 1 was repeated except for using a silicone rubber by screen printing in place of the polytetrafluoroethylene film by pressing with heating.

EXAMPLE 5

Figure 7A:
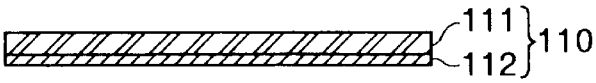
FIGS. 7A to 7H are cross-sectional views (FIGS. 7A to 7F, and 7H) and a top plan view (FIG. 7G) for explaining the steps for producing another example of chip-type current protector of the present invention.

As shown in FIG. 7A, a composite metal foil 110 comprising an aluminum carrier 111 having a copper layer 112 of 5 μm was prepared.

Figure 7B:
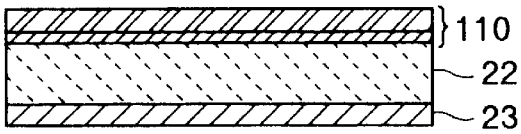

An insulating substrate as shown in FIG. 7B was prepared by bonding the composite metal foil to a substrate 22 so as to contact the copper layer to the substrate, while bonding a copper foil 23 having a thickness of 18 μm to another side of the substrate. Then, the aluminum carrier was peeled off.

The substrate 22 used was the same as that used in Example 3 and the same press conditions as used in Example 3 were used.

Figure 7C:
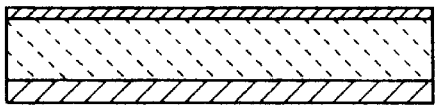
Figure 7D:
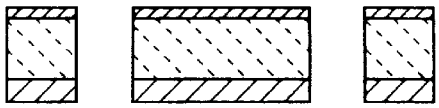
Figure 7E:
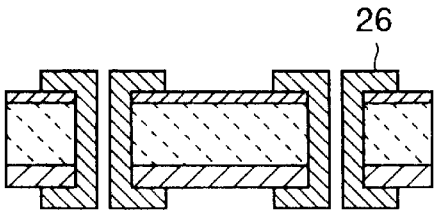

Holes for connecting terminals were drilled as shown in FIG. 7D and a plating resist was formed except for portions for forming terminals as shown in FIG. 7E, followed by electroplating to give a coating of 15 μm thick (drawings showing the formation of plating resist and peeling were omitted).

Figure 7F:
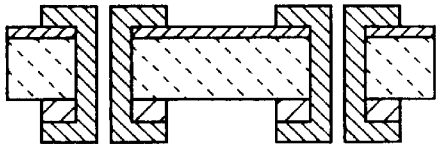
Figure 7G:
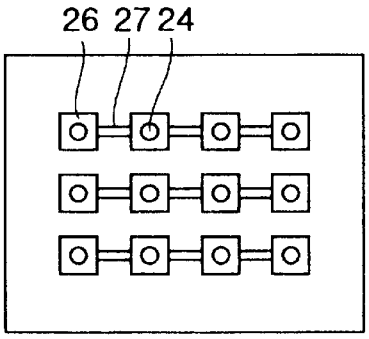

Then, the ultra-thin copper layer was etched so as to form in parallel a plurality of rows of a series of lectrical conductors interposing terminals therebetween lternately (FIGS. 7F and 7G).

Figure 7H:
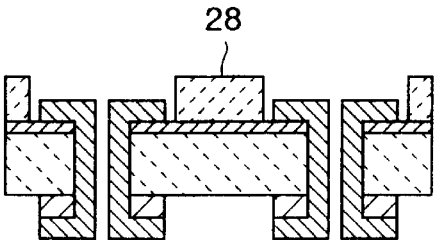

On the surface of the resulting substrate, fron PFA film having a thickness of 50 μm was laminated nd pressed at 340° C. under a pressure of 20 kgf/cm$^2$ using a vacuum press (FIG. 7H).

In FIGS. 7F to 7H, numeral 24 denotes the holes for connecting terminals, numeral 27 denotes the electric conductors, and numeral 28 denotes the resin film.

The resulting substrate was cut with a diamond cutter so as to give individual current protector chips.

The current protectors obtained by Examples 3 to and Comparative Example 1 had the electrical conductor width of 0.05 mm and a resistance value of about 180 mΩ.

Scattering of the resistance values was with 10%.

The results of clearing test revealed that no smoking was observed at the time of blowing as to the current protectors of Examples 3 to 5, but smoking for 1 or 2 seconds was observed under current passing conditions for making the blowing time 30 seconds or more in Comparative Example 1.

As explained above, the current protector chips of the second modification are excellent in suppressing ignition and smoking. Further, since a metal foil having a constant thickness is used when better accuracy is necessary for the electrical conductors, the accuracy of the thickness of the electrical conductors is good, resulting in improving the conductor width accuracy. Thus, the scattering of resistance values is very reduced and the clearing characteristics are excellent.

EXAMPLE 6

Figure 10A:
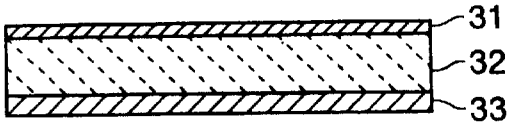
FIGS. 10A to 10I are cross-sectional views (FIGS. 10A, 10C to 10H) and top plan views (FIGS. 10B and 10I) for explaining the steps for producing one example of chip-type current protector of the present invention.

As shown in FIG. 10A, an insulating substrate was prepared by bonding a ultra-thin copper foil 31 on one side of a substrate 32 and bonding a copper foil 33 having a thickness of 18 μm on another side of the substrate.

As the substrate, there was used a glass cloth-reinforced polytetrafluoroethylene resin prepreg, and press conditions at 380° C. for 90 minutes under a pressure of 20 kgf/cm$^2$ were used.

Figure 10B:
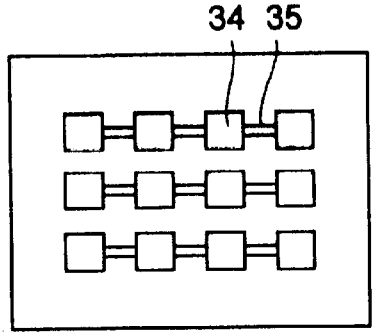

Electrical conductors were formed by etching the ultra-thin copper foil layer using a pattern wherein a plurality of rows were arranged in parallel, each row arranging in series electrical conductors 35 interposing terminals 34 therebetween alternately (FIG. 10B).

Figure 10C:
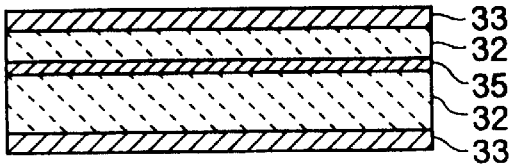
Figure 10D:
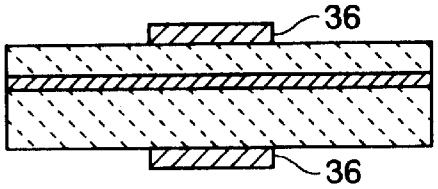

Then, a copper foil 33 formed on a polytetrafluoroethylene resin prepreg 32 was laminated and bonded by pressing with heating (FIG. 10C). The copper foils were etched to remove unnecessary portions to give light-shielding metal foils 36 (FIG. 10D).

Figure 10E:
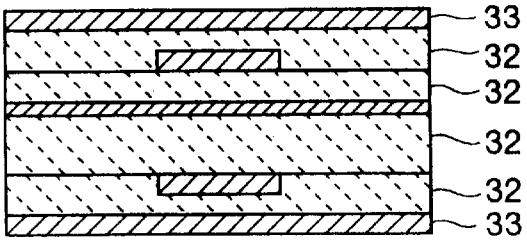

A pair of substrate 32 having a copper foil 33 on one side thereof were laminated again and pressed with heating (FIG. 10E).

Figure 10F:
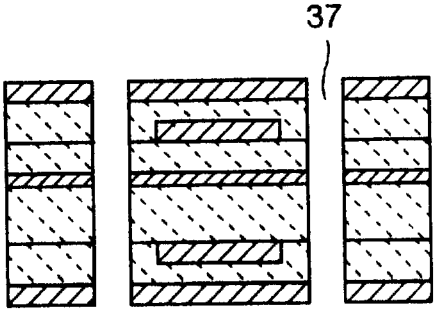
Figure 10G:
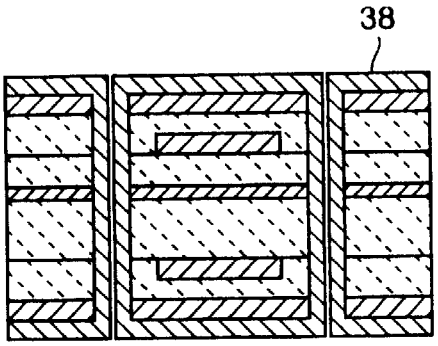
Figure 10H:
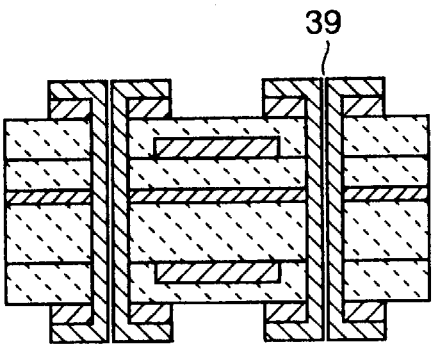
Figure 10I:
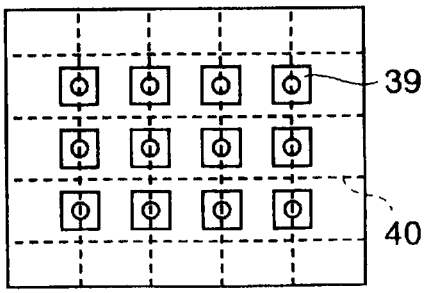

Holes 37 for connecting terminals were formed (FIG. 10F) and plating was carried out to form plate coating 38 having a thickness of 15 μm (FIG. 10G). Terminals 39 were formed by etching (FIGS. 10H and 10I). In FIG. 10I, numeral 40 denotes cutting lines for individual current protector chips.

Comparative Example 2

Using the same materials and steps as used in Example 6, an insulating substrate having an ultra-thin copper foil on one side was prepared, followed by formation of electric conductors by etching.

Then, a substrate having a copper foil was laminated and pressed with heating, followed by drill of holes for connecting terminals and plating to give a coating of 15 μm thick in the holes. Then, terminals were formed by etching.

The thus produced substrates in Example 6 and Comparative Example 2 were cut to give current protector chips.

The resulting current protector chips had the conductor width of 0.05 mm and the resistance value of about 180 mΩ. The scattering of resistance values was within 10%.

The results of clearing test revealed that no light and no smoke were admitted in Example 6 at the blowing, while in Comparative Example 2, a bright light emission from the insulating substrate was observed at the time of blowing. This means that sparks at the time of blowing was observed through the insulating substrate.

As mentioned above, by the use of light-shielding metal foils, the light emission caused by blowing is not observed. Needless to say, the current protector is also excellent in suppression of ignition and smoking.

EXAMPLE 7

An aluminum carrier having an ultra-thin copper foil having a thickness of 5 μm (FIG. 7A) was bonded to a substrate 22 on one side thereof, and a copper foil 23 having a thickness of 18 μm was bonded to another side of the substrate 22 (FIG. 7B). Then, the aluminum carrier was peeled (FIG. 7C). As the substrate 22, polytetrafluoroethylene resin prepreg was used and the pressing conditions were a temperature of 380° C., a time of 90 minutes and a pressure of 20 kgf/cm$^2$ for lamination and adhesion. Holes for connecting terminals were drilled (FIG. 7D), followed by formation of a resist on non-plation portions. Plating was carried out to give a coating 26 of 15 μm on the terminal portions and in the holes.

A pattern for electric conductors was formed by etching. The pattern had a plurality of rows of a series of electrical conductors interposing terminals there-between alternately (FIGS. 7F and 7G). On the surface the resulting substrate, a polytetrafluoroethylene resin film (Nitoflon film, a trade name, mfd. by Nitto Electric Industrial Co., Ltd.) having a thickness of 100 μm and also having holes in the portions corresponding to terminals was laminated and pressed at 380° C. for 30 minutes under a pressure of 20 kgf/cm$^2$ (see FIGS. 6H and 7H)

EXAMPLE 8

A composite metal foil 100 having a three-layer structure as shown in FIG. 6A was prepared. In FIG. 6A, numeral 101 denotes a first copper layer having a thickness of 15 μm, numeral 102 denotes an intermediate Ni—P alloy layer having a thickness of 0.2 μm, and numeral 103 denotes a second copper layer having a thickness of 5 μm. The composite metal foil was bonded to an substrate 22 so as to contact the second copper layer to the substrate and a copper foil 23 of 18 μm thick was bonded to another side of the substrate (FIG. 6B).

As the material for the substrate, glass cloth-reinforced polytetrafluoroethylene resin prepreg was used. The pressing conditions were the same as described in Example 7.

Holes 24 for connecting terminals were drilled (FIG. 6C) and plated coating 25 of 15 μm thick was formed (FIG. 6D).

The first copper layer (and the previously plated coating) except for the portions to be formed into terminals was removed as shown in FIG. 6E using an alkaline etching solution (an A Process, a trade name, mfd. by Meltex Inc.) to form terminal portions 26.

Then, as shown in FIG. 6F, using an etching solution having nitric acid and hydrogen peroxide as major components, the intermediate Ni—P alloy layer exposed by the etching of the first copper layer was removed.

Then, the second copper layer was etched so as to form in parallel a plurality of rows of a series of electrical conductors interposing terminals therebetween alternately (FIGS. 6F and 6G).

On the surface of the thus treated substrate, a tetrafluoroethylene-perfluoroalkoxyethylene copolymer film (Aflon PFA, a trade name, mfd. by Asahi Kasei Kogyo K.K.) having a thickness of 100 μm and also having holes in the portions corresponding to terminals was laminated and pressed at 340° C. for minutes under a pressure of 20 kgf/cm$^2$ (FIGS. 6H and 6I).

EXAMPLE 9

In the same manner as described in Example 7, an insulating substrate having an ultra-thin copper film of 5 μm thick on one side and a copper foil of 18 μm thick on another side of the substrate (FIG. 7C).

Holes 24 for connecting terminals were drilled (FIG. 7D), and a resist was formed on non-plated portions, followed by plating to give a coating having a thickness of 15 μm on the electrode portions and in the holes.

The pattern for electrical conductors having the same shape as in Examples 7 and 8 was formed by etching (FIGS. 7E and 7G). On the resulting surface, a tetrafluoroethylene-ethylene copolymer film (Aflex COP film, a trade name, mfd. by Asahi Kasei Kogyo K.K.) having a thickness of 50 μm and having holes in portions corresponding to the terminals was laminated and pressed with heating in the same manner as described in Example 7 (FIGS. 6H and 7H).

EXAMPLE 10

Figure 12A:
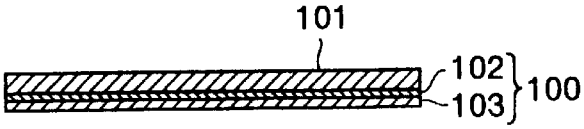
FIGS. 12A to 12I are cross-sectional views (FIGS. 12A to 12D, and 12F to 12H) and a top plan view (FIG. 11E) for explaining the steps for producing an example of chip-type current protector of the present invention.
Figure 12B:
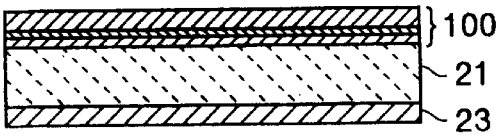

Using a composite metal foil 100 having a three-layer structure, a metal foil-clad insulating substrate 21 was prepared in the same manner as described in Example 8 (FIG. 12B).

Figure 12C:
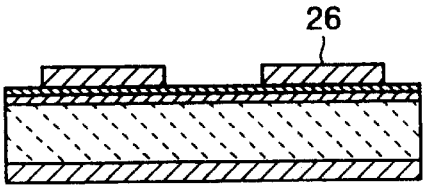
Figure 12D:
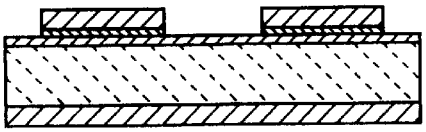
Figure 12E:
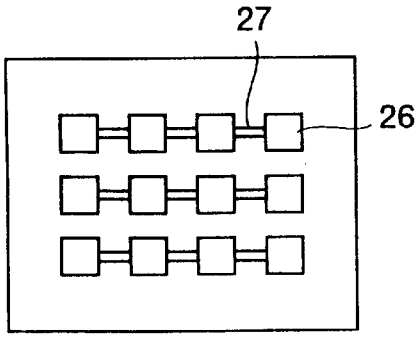

Then, the first copper layer 101 except for special portions (portions for forming electrical conductors and terminals positioned on the same level) was removed by etching (FIG. 12C). Then, the intermediate layer 102 was removed to expose the second copper layer 103, followed by etching of the second copper layer to form a plurality of electrical conductors 27 (FIGS. 12D and 12E).

Figure 12F:
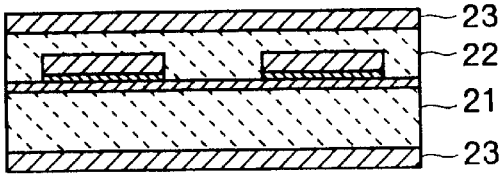

The resulting insulating substrate having electric conductors, a tetrafluoroethylene-ethylene copolymer film (Aflex COP film, a trade name, mfd. by Asahi Glass Co., Ltd.) having a thickness of 12 μm, and an insulating substrate made from a glass cloth-reinforced polytetrafluoroethylene resin and having a copper foil on one side were laminated and bonded (FIG. 12F) (the film is omitted in the drawing). The pressing conditions were a temperature of 280° C., a time of 30 minutes, and a pressure of 20 kgf/cm$^2$.

Figure 12G:
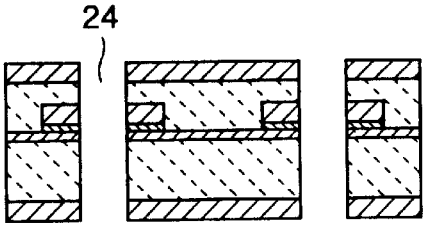
Figure 12H:
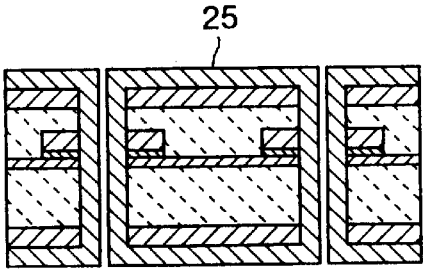
Figure 12I:
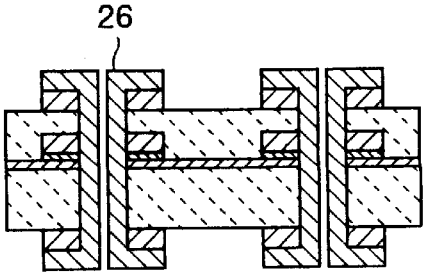

Holes 24 for connecting terminals were drilled in the resulting laminate (FIG. 12G), conductors 25 were formed in the holes by plating (FIG. 12H), and conductive terminals 26 were formed by etching (FIG. 12I).

Comparative Example 3

A glass cloth-reinforced polytetrafluoroethylene resin-made substrate having copper foils on both sides thereof was subjected to drilling of holes for connecting terminals, etching of the whole surfaces of the copper foils, pretreatment of plating, and panel electric copper plating to deposit copper in 5 μm thickness. Then, a pattern for electrical conductors was formed by etching in the same manner as described in Examples 7 to 9. Then, a silicone rubber was screen printed to cover the electrical conductors.

The thus produced current protector chip-holding insulating substrates obtained in Examples 7 to 10 and Comparative Example 3 were cut at the center of the holes for connecting terminals to give a number of current protector chips.

Each current protector chip had a conductor width of 0.05 mm and the resistance value of about 180 mΩ.

The scattering of resistance values was within 10% in Examples 7 to 10, but was over 30% in Comparative Example 3. Further, in the clearing test, no smoke nor spark were admitted in Examples 7 to 10, but smoking for 1 to 2 seconds was observed in Comparative Example 3 under the conditions of making the clear time 30 seconds or more.

The current protectors, 20 samples for each Example, were subjected to the heat cycle test at −40° C. and 125° C. for 1000 cycles.

After the test, the change of resistance value was within 10% in Examples 7 to 10, and no disconnection was observed.

In Comparative Example 3, disconnection was generated in 4 samples, and even if not disconnected, the resistance value changed remarkably.

As mentioned above, by the fourth modification, there can be obtained current protector chips excellent in suppression of ignition and smoking, having improved reliability for a long period of time, and able to be blowed even at low electric current.

EXAMPLE 11

Figure 14A:
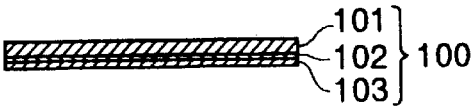
FIGS. 14A to 14J are cross-sectional views (FIGS. 14A to 14D and 14F to 14J) and a top plan view (FIG. 11E) for explaining the steps for producing an example of chip-type current protector of the present invention.

As shown in FIG. 14A, a composite metal foil 100 having a first copper layer 101 of 15 μm thick, an intermediate layer 102 of Ni—P alloy of 0.2 μm thick and a second copper layer 103 of 5 μm thick was prepared.

Figure 14B:
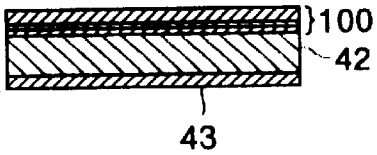

The second copper layer of the composite metal foil was bonded to one side of an insulating substrate 42 and a copper foil 43 of 18 μm was also bonded to another side of the substrate as shown in FIG. 14B.

As the material for the substrate, a glass cloth-reinforced polytetrafluoroethylene resin prepreg was used. The pressing conditions were a temperature of 380° C., a time of 90 minutes and a pressure of 20 kgf/cm$^2$.

Figure 14C:
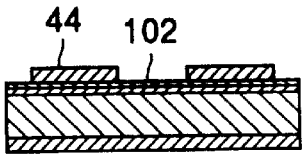

As shown in FIG. 14C, unnecessary portions of the first copper layer were removed by using an etching solution (A Process, a trade name, mfd. by Meltex Inc.) to form terminals 44.

Figure 14D:
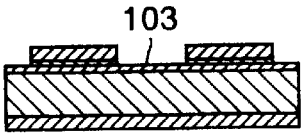

Using an etching solution containing nitric acid and hydrogen peroxide as major components, the intermediate layer exposed by removal of the first copper layer was removed (FIG. 14D).

Figure 14E:
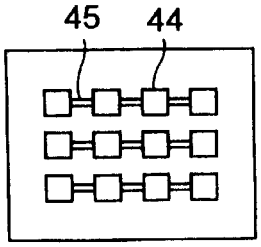

Then, the second copper layer was etched so as to form in parallel a plurality of rows of a series of electrical conductors 45 interposing terminals 44 therebetween alternately (FIG. 14E).

Figure 14F:
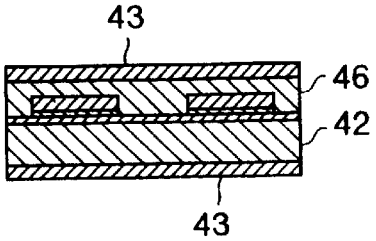

On the resulting surface, a polytetrafluoroethylene resin film 46 and a copper foil 43 were bonded with heating at 380° C. for 40 minutes under a pressure of 20 kgf/cm$^2$ (FIG. 14F).

Figure 14G:
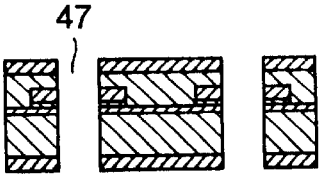
Figure 14H:
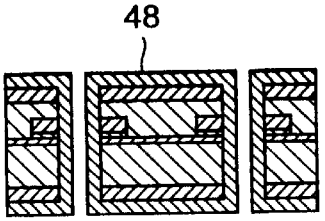

Holes 47 for connecting terminals were drilled (FIG. 14G) and plated coatings 48 of 15 μm thick were formed by plating (FIG. 14H).

Figure 14I:
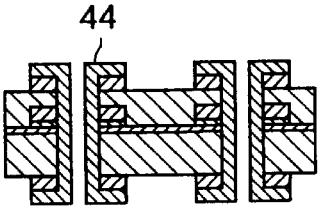

Terminals 44 were formed by etching (FIG. 14I).

Then, a voltage was applied to both ends of terminals connected in series through current protectors to pass an electric current of 1.2 A for 60 seconds.

Figure 14J:
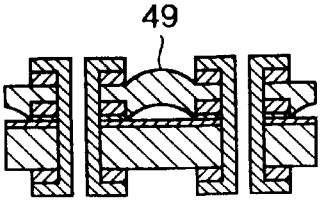

As a result, slight vacant spaces 49 between the polytetrafluoroethylene resin film and the electric conductors were admitted (FIG. 14J).

EXAMPLE 12

The process of Example 11 was repeated except for using a tetrafluoroethylene-perfluoroalkoxyethylene copolymer film (Aflon PFA film, a trade name, mfd. by Asahi Kasei Kogyo K.K.) having a thickness of 100 μm in place of the polytetrafluoroethylene resin film used in Example 11 and changing the pressing conditions to a temperature of 340° C., a time of 30 minutes and a pressure of 20 kgf/cm$^2$.

After passing an electric current of 1.2 A for 60 seconds, slight vacant spaces were admitted between the PFA film and the electrical conductors as in Example 11.

Reference Example 1

Example 11 was repeated except for not passing the electric current.

Reference Example 2

Example 12 was repeated except for not passing the electric current.

The thus produced current protector chip-holding insulating substrates obtained in Examples 11 and 12, and Reference Examples 1 and 2 were cut at the center of the holes for connecting terminals to give a number of current protector chips.

Each current protector chip had a conductor width of 0.05 mm and the resistance value of about 180 mΩ.

After subjecting to the clearing test, 20 samples of Example 11 and 20 samples of Example 12 showed the resistance value of 10 megohms or more, and almost on the order of gigaohm.

In Reference Examples 1 and 2, the resistance value after the clearing test was in the range of 50 kilohms to 500 megohms.

No ignition nor smoking were observed in Examples 11 and 12, and Reference Examples 1 and 2.

As explained above, the fifth modification gives excellent insulation properties after blowing as well as excellent in suppression of ignition and smoking.

EXAMPLE 13

Figure 17A:
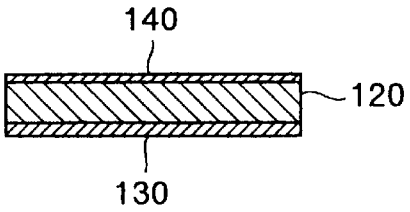
FIGS. 17A to 17I are cross-sectional views (FIGS. 17A and 17C to 17I) and a top plan view (FIG. 17B) for explaining the steps for producing an example of chip-type current protector of the present invention.

As shown in FIG. 17A, an insulating substrate 120 having a ultra-thin copper foil of 5 μm thick on one side and a copper foil of 18 μm thick on the other side was prepared.

As the material for the substrate, a glass cloth-reinforced polytetrafluoroethylene resin prepreg was used and the pressing conditions were a temperature of 380° C., a time of 90 minutes, and a pressure of 20 kgf/cm$^2$.

Figure 17B:
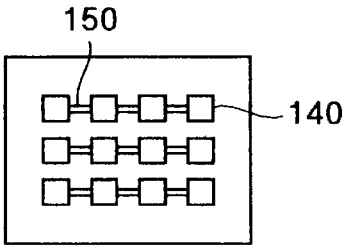

A pattern for electrical conductors was formed by etching of the ultra-thin copper foil. The pattern had a plurality of rows of a series of electrical conductors 150 interposing terminals 140 therebetween alternately (FIG. 17B).

Figure 17C:
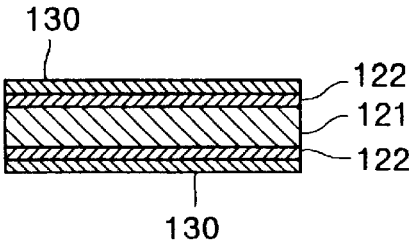

On the other hand, a two-sided copper-clad laminate (substrate 121) made of a glass cloth-reinforced polytetrafluoroethylene resin was subjected to etching of whole surfaces of both sides, followed by lamination of a tetrafluoroethylene-ethylene copolymer 122 (Alfex film, a trade name, mfd. by Asahi Glass Co., Ltd.) having a copper foil 130 on one side thereof on both sides of the substrate 121 and pressing at 280° C. for 30 minutes under a pressure of 20 kgf/cm$^2$ (FIG. 17C).

Figure 17D:
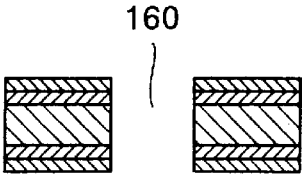
Figure 17E:
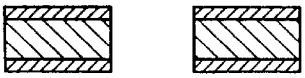

Holes 160 for forming vacant spaces were drilled (a diameter 1.2 mm) (FIG. 17D), and the copper foils 130 on both sides were removed by etching to give an insulating material having holes for forming vacant spaces (FIG. 17E).

Figure 17F:
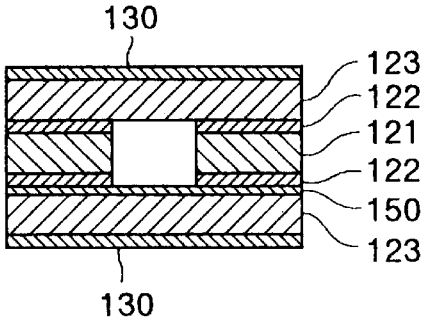
Figure 17G:
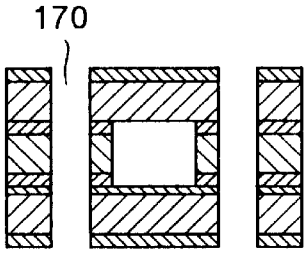
Figure 17H:
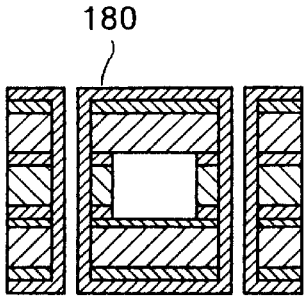

The substrate having the electric conductors (FIG. 17B), the insulating material having the holes (FIG. 17E) and an insulating plate made of a glass cloth-reinforced polytetrafluoroethylene resin and having a copper foil 130 on one side were laminated and pressed with heating (FIG. 17F). Holes 170 for connecting terminals were drilled, followed by formation of a plated coating 180 of 15 μm thick in the holes (FIGS. 17G and 17H)

Figure 17I:
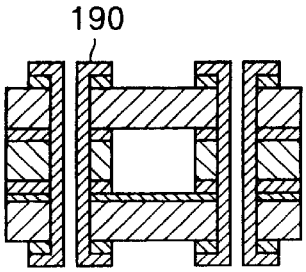

Terminals 190 were formed by etching (FIG. 17I).

EXAMPLE 14

Figure 18A:
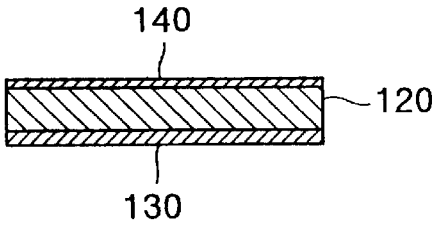
FIGS. 18A to 18G are cross-sectional views (FIGS. 18A and 18C to 18G) and a top plan view (FIG. 18B) for explaining the steps for producing another example of chip-type current protector of the present invention.
Figure 18B:
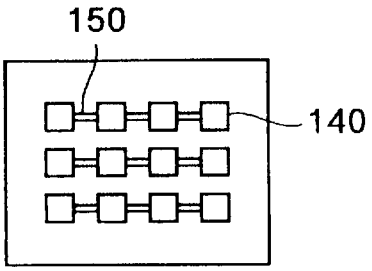

Using the same materials (e.g. FIG. 18A wherein numeral 140 denotes ultra-thin copper foil, numeral 130 denotes a copper foil, and numeral 120 denotes a substrate) and the steps as in Example 13, a pattern for electrical conductors 150 and terminals 140 (FIG. 18B) was formed on insulating substrate.

Figure 18C:
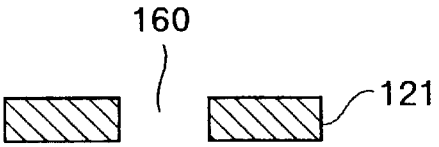

On the other hand, a glass cloth-reinforced polytetrafluoroethylene resin-made laminate having copper foils on both sides thereof was drilled to form holes 160 (diameter 1.2 mm) for forming vacant spaces, followed by removal of the copper foils by etching to give an insulating material having the holes (FIG. 18C).

Figure 18D:
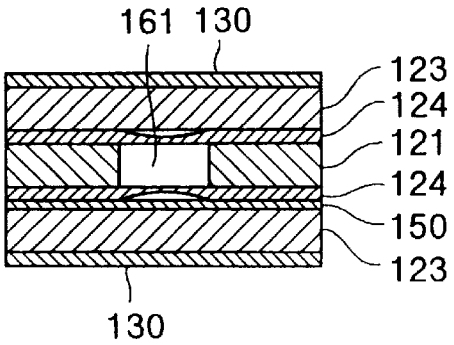

The insulating substrate 123 having the electrical conductors 150 thereon, the insulating material 121 having the vacant spaces 161 therein covered with a tetrafluoroethylene-ethylene copolymer film 124 (Aflex film, a trade name, mfd. by Asahi Glass Co., Ltd.) of 12 μm thick, and a polytetrafluoroethylene resin-made insulating plate 123 having a copper foil 130 on one side thereof were laminated and pressed at 280° C. for 30 minutes under a pressure of 20 kgf/cm$^2$ (FIG. 18D).

Figure 18E:
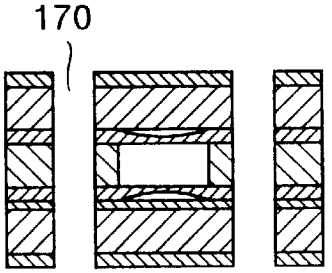
Figure 18F:
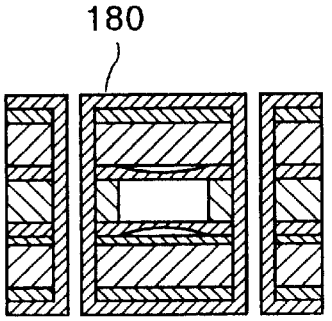
Figure 18G:
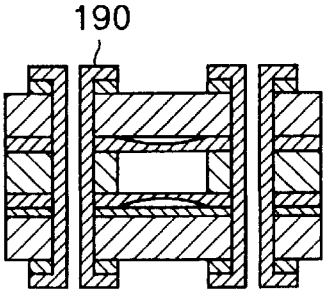

Holes 170 for connecting terminals were drilled (FIG. 18E), followed by formation of plated coating 180 of 15 μm thick (FIG. 18F) and formation of terminals 190 by etching (FIG. 18G).

EXAMPLE 15

Figure 19A:
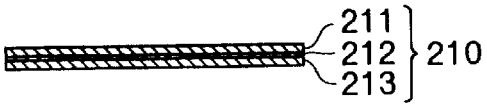
FIGS. 19A to 19J are cross-sectional views (FIGS. 19A to 19D, and 19F to 19J) and a top plan view (FIG. 19E) for explaining the steps for producing a further example of chip-type current protector of the present invention.

A composite metal foil 210 as shown in FIG. 19A having a first copper layer 211 of 15 μm thick, an intermediate layer 212 of Ni—P alloy of 0.2 μm thick and a second copper layer 213 of 5 μm thick was prepared.

Figure 19B:
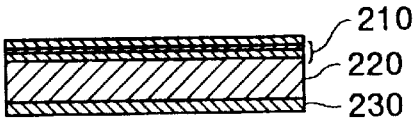

An insulating substrate having the composite metal foil on one side so as to contact the second copper layer to an substrate 220 and a copper foil 230 of 18 μm on the other side of the substrate was prepared (FIG. 19B). The lamination and bonding conditions were the same as those of Example 17 (see FIG. 17A).

Figure 19C:
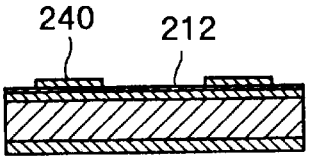
Figure 19D:
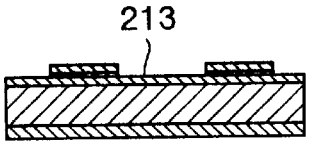
Figure 19E:
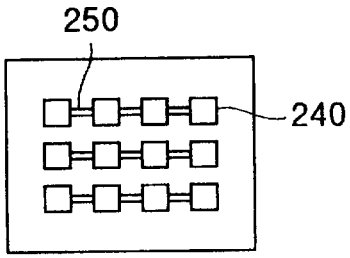

Special portions (for forming terminals 240) were removed from the first copper layer by etching (FIG. 19C). Then, the intermediate layer was removed to expose the second copper layer, followed by formation of a plurality of electric conductors 250 by etching of the second copper layer (FIGS. 19D and 19E).

Figure 19F:
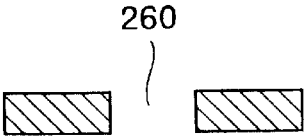

On the other hand, a glass cloth-reinforced polytetrafluoroethylene resin-made substrate 220 having holes 260 for forming vacant spaces was prepared (FIG. 19F).

Figure 19G:
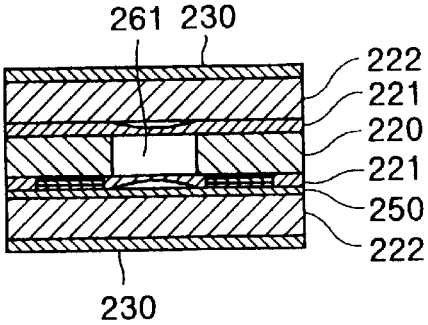

The insulating substrate having electrical conductors 250 thereon, the substrate having holes for forming vacant spaces and covered with a tetrafluoroethylene-ethylene copolymer film 221 of 12 μm thick (Aflex film, a trade name, mfd. by Asahi Glass Co., Ltd.) on both sides thereof, and an insulating material 222 having a copper foil 230 on one side thereof were laminated so as to adjust the holes being positioned over the electrical conductors, respectively, and bonded at 280° C. for minutes under a pressure of 20 kgf/cm$^2$ (FIG. 19G).

Figure 19H:
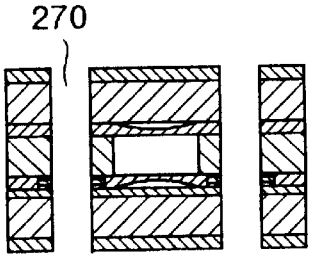
Figure 19I:
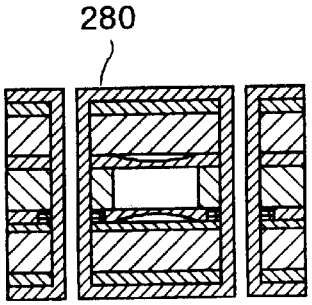
Figure 19J:
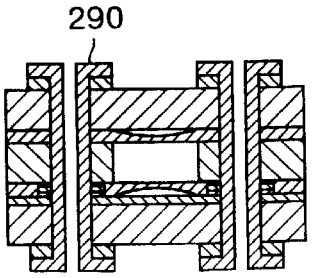

Holes 270 for connecting terminals were drilled in the resulting laminate (FIG. 19H), followed by plating (FIG. 19I, numeral 280 denotes a plated coating) to forming conductors in the holes and formation of terminals 290 by etching (FIG. 19J).

Reference Example 3

The process of Example 14 was repeated except for not forming holes for vacant spaces in the substrate.

The thus produced current protector chip-holding laminates obtained in Examples 13 to 15 and Reference Example 3 were cut to give a number of current protector chips.

Each current protector chip had a conductor width of 0.05 mm and the resistance value of about 180 mΩ.

After subjecting to the clearing test, 20 samples of Example 13 and 20 samples of Example 14 showed the resistance value of 10 megohms or more, and almost on the order of gigaohm.

In Reference Example 3, the resistance value after the clearing test was in the range of 50 kilohms to 500 megohms.

No ignition nor smoking were observed in Examples 13 to 15 and Reference Example 3.

As mentioned above, by forming the vacant spaces at least around the electric conductors, the reliability is improved for a long period of time and the insulation resistance is high after blowing.

EXAMPLE 16

Figure 20A:
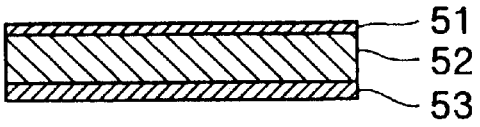
FIGS. 20A to 20F are cross-sectional views (FIGS. 20A and 20C to 20F) and a top plan view (FIG. 20B) for explaining the steps for producing an example of the current protector of the present invention.

An insulating substrate (FIG. 20A) was prepared by bonding a ultra-thin copper foil 51of 5 μm thick on one side of a substrate 52 and a copper foil 53 of 18 μm thick on another side of the substrate. As the material for the substrate, a glass cloth-reinforced polytetrafluoroethylene resin prepreg was used and the pressing conditions were a temperature of 380° C., a time of 90 minutes and a pressure of 20 kgf/cm$^2$.

Figure 20D:
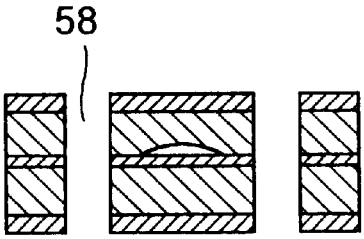
Figure 20B:
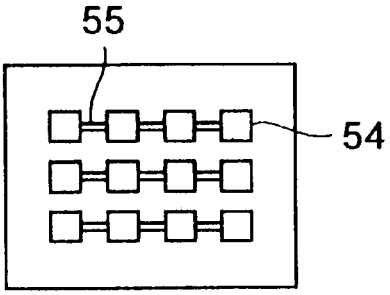

A pattern for electrical conductors was formed by etching of the ultra-thin copper foil. The pattern had a plurality of rows of a series of electrical conductors 55 interposing terminals 54 therebetween alternately (FIG. 20B).

The insulating substrate having electrical conductors thereon, and a glass cloth-reinforced polytetrafluoroethylene resin-made substrate having a copper foil on one side thereof were laminated via a tetrafluoro-ethylene copolymer film (Aflex COP film, a trade name, mfd. by Asahi Glass Co., Ltd.) of 6 μm thick and bonded. In this case, in order to not press the special portions 57 of the laminate (i.e. the portions to be formed into electrical conductors and therearound), a metal plate 56 having holes was used (FIG. 20C, the resin film of 6 μm thick being omitted).

Figure 20E:
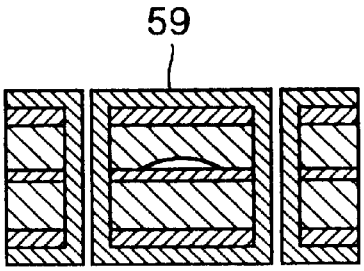

Holes 58 for connecting terminals were drilled (FIG. 20D), followed by formation of plated coating 59 of 15 μm (FIG. 20E).

Figure 20C:
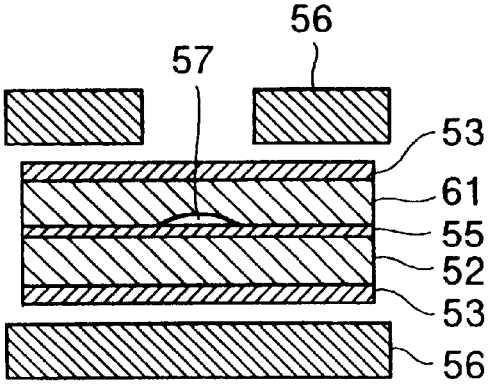
Figure 20F:
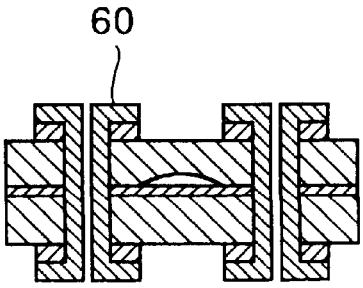

Terminals 60 were formed by etching (FIG. 20F).

EXAMPLE 17

A composite metal foil having a first copper layer of 15 μm thick, an intermediate layer of Ni—P alloy of 0.2 μm thick and a second copper layer of 5 μm thick was prepared.

An insulating substrate was prepared by bonding the composite metal foil so as to contact the second copper layer with one side of a substrate, and bonding a copper foil of 18 μm thick to another side of the substrate in the same manner as described in Example 16.

Then, the first copper layer was removed (the shape being the same as in FIG. 20A), followed by removal of the intermediate layer to expose the second copper layer. The second copper layer was subjected to etching to form a plurality of electrical conductors (the shape being the same as in FIG. 20B).

The insulating substrate having electrical conductors thereon covered with a pair of a tetrafluoroethylene-ethylene copolymer film (Aflex film, a trade name, mfd. by Asahi Glass Co., Ltd.) of 12 $\mu$m thick and a glass cloth-reinforced polytetrafluoroethylene resin-based substrate having a copper foil on one side thereof were laminated under a metal plate for pressing having holes so as not to press the special portions of the laminate, while adjusting the positions of the electrical conductors and the holes in the pressing metal plate, followed by pressing at 280° C. for 30 minutes under a pressure of 20 kgf/cm$^2$ (see FIG. 20C).

The resulting laminate was subjected to drilling for forming holes for connecting terminals, plating for forming conductors in the holes and etching for forming terminals.

Reference Example 4

The process of Example 16 was repeated except for not using the metal plate for pressing having holes.

The thus produced current protector chip-holding laminates obtained in Examples 16 and 17 and Reference Example 4 were cut to give a number of current protector chips.

Each current protector chip had a conductor width of 0.05 mm and the resistance value of about 180 mΩ. The scattering of resistance values was within 10%.

After subjecting to the clearing test, 20 samples of Example 16 and 20 samples of Example 17 showed the resistance value of 10 megohms or more, and almost on the order of gigaohm.

In Reference Example 4, the resistance value after the clearing test was in the range of 50 kilohms to 500 megohms.

No ignition nor smoking were observed in Examples 16 and 17 and Reference Example 4.

As mentioned above, by making electrical conductors have spaces or non-adhesion portions with regard to underlying substrate, there can be obtained current protectors improved in accuracy for forming electrical conductors and reliability for a long period of time, and are high in insulation resistance after blowing.

What is claimed is:

1. A current protector comprising an organic resin-made insulating substrate, a pair of conductive terminals formed on both ends of the insulating substrate, and an electrical conductor for electrically connecting the terminals, said electrical conductor including one or more fusible links, formed in or on the insulating substrate and made of a metal layer having a thickness of 3 to 8 $\mu$m, wherein the current protector is in the form of a chip and the electrical conductor is formed in the insulating substrate and sandwiched by a pair of light-shielding metal foils.

2. A process for producing the current protector of claim 1, which comprises the steps of:

a. forming an article having electrical conductors which are formed by etching one of metal foils clad on both sides of an insulating substrate, b. laminating the article having electrical conductors, a fluorine resin-made prepreg or a fluorine resin-made film, and a metal foil, followed by adhesion so as to have the metal foils at the outmost surfaces, c. removing the metal foils of the resulting laminate except for special portions by etching to form light-shielding metal foil portions, d. laminating the etched article, a fluorine resin-made prepreg or a fluorine resin-made film, and a metal foil, followed by adhesion so as to have the metal foils at the outmost surfaces, e. drilling holes for connecting terminals, f. conducting plating so as to have conductors in the holes for connecting terminals, g. forming conductive terminals by etching, and h. cutting the center of the holes for connecting terminals so as to give a number of current protector chips, each chip having conductive terminals at both ends interconnected by the electrical conductor.

3. A process for producing the current protector of claim 1, which comprises the steps of:

a. forming an article having electrical conductors on one side by etching of one of metal foils clad on an insulating substrate, followed by formation of a light-shielding metal foil on another side of the article, b. forming a light-shielding metal foil by etching one of metal foils clad on another insulating substrate to give an insulating substrate having a light-shielding metal foil on one side, c. laminating a metal foil, the article having the light-shielding metal foil on one side and the electric conductors on another side, and a fluorine resin-made prepreg or a fluorine resin-made film, and the insulating substrate having the light-shielding metal foil on one side, followed by adhesion so as to have the metal foils at the outmost surfaces, d. drilling holes for connecting terminals in the resulting laminate, e. conducting plating so as to have conductors in the holes for connecting terminals, f. forming conductive terminals by etching, and g. cutting the center of the holes for connecting terminals so as to give a number of current protector chips, each chip having conductive terminals at both ends interconnected by the electrical conductor.

* * * * *